US006738590B2

(12) United States Patent
Okimura et al.

(10) Patent No.: US 6,738,590 B2
(45) Date of Patent: May 18, 2004

(54) IMAGE FORMING APPARATUS WITH DETACHABLE IMAGE FORMING UNIT ASSEMBLY

(75) Inventors: Naomasa Okimura, Iwatsuki (JP); Takeshi Okoshi, Iwatsuki (JP); Hiromitsu Koizumi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 31 days.

(21) Appl. No.: 10/097,563

(22) Filed: Mar. 15, 2002

(65) Prior Publication Data

US 2002/0181968 A1 Dec. 5, 2002

(30) Foreign Application Priority Data

May 29, 2001 (JP) ..... 2001-160658
Jun. 1, 2001 (JP) ..... 2001-166797
Jan. 8, 2002 (JP) ..... 2002-001442

(51) Int. Cl.[7] ..... G03G 21/18
(52) U.S. Cl. ..... 399/111; 399/112; 399/121
(58) Field of Search ..... 399/111, 112, 399/116, 121

(56) References Cited

U.S. PATENT DOCUMENTS 5,146,270 A * 9/1992 Matsuo et al. ..... 399/112
5,870,659 A * 2/1999 Maruyama et al. ..... 399/112 X
6,381,428 B1 * 4/2002 Yamamoto et al. ..... 399/116
6,484,003 B2 * 11/2002 Tokutake et al. ..... 399/112 X

FOREIGN PATENT DOCUMENTS

JP U 62-29148 2/1988
JP A 8-36346 2/1996
JP A 10-78686 3/1998
JP A 11-72983 3/1999

* cited by examiner

*Primary Examiner*—William J. Royer
(74) *Attorney, Agent, or Firm*—Oliff & Berridge, PLC

(57) ABSTRACT

A print head device, which includes a plurality of image carrying bodies, a plurality of developing units, a plurality of charging units, and at least one intermediate transfer unit, is constructed as a unit assembly, and the unit assembly is inserted into and removed from image forming apparatus main body. The image forming apparatus contains a mechanism that the image carrying bodies are minutely movably supported by a frame of the unit assembly with a gap being located therebetween, and are positioned and fixed to a housing of the image forming apparatus main body.

31 Claims, 24 Drawing Sheets

IMAGE FORMING APPARATUS WITH DETACHABLE IMAGE FORMING UNIT ASSEMBLY

BACKGROUND OF THE INVENTION

1. Field of Invention

The present invention relates to an image forming apparatus such as a printer, a copying machine or a facsimile machine, for forming color and black/white images based on an image forming process, e.g., electrophotography, electrostatic recording system, ionography, magnetic recording system and the like. More particularly, the invention relates to an electrophotographic image forming apparatus of the tandem type which is provided with a plurality of photoreceptor drums and a plurality of image carrying bodies, and is free from color misregistration after it is commercially supplied and undergoes maintenance and is capable of forming images of high quality for a long period of time. Further, the invention relates to a small color electrophotographic image forming apparatus which is small in size and low in cost, and improved in the operability of an image forming unit.

2. Description of Related Art

Various types of xerographic based image forming apparatus for forming color and black/white pictures, such as printers and copying machines, have been proposed and marketed. In particular recently, much effort has been made to develop color printers with the spread of personal computers, internet, digital cameras, and the like. In the field of image forming apparatus, e.g., color printers, there is a strong demand for developing an apparatus which is capable of forming office-use color images, and is operable at a high speed, compact in size, and low in cost.

To form a color image of high quality by using image forming apparatus, such as a color printer, it is necessary to improve accuracy of color registration, i.e., a registration of color component images. That is, to form a color image, color component images of colors, e.g., cyan, magenta, yellow, and black, are formed on an image bearing member, and those color component images are accurately registered to one another and superimposed one upon another.

An image forming apparatus of the tandem type is known for the image forming apparatus, such as a printer. This type of image forming apparatus includes a plurality of image forming units with photoreceptor drums as image carrying bodies corresponding to colors of toner images to be formed, e.g., cyan, magenta, yellow and black. Those color component toner images are successively formed on the image carrying bodies (e.g., photoreceptor drums) of the image forming units. Those toner images are transferred on a recording sheet or an intermediate transfer member in a superimposing fashion.

The tandem type image forming apparatus includes a plurality (e.g., four) of image forming units for forming color component images. Therefore, to improve the accuracy of color registration of the color component images as formed by the image forming units, it is necessary to locate the color component images formed by the image forming units accurately in predetermined positions. To this end, the image forming units of the tandem type are arranged such that the accuracy of color registration, which is performed when the images formed by the image forming units are superimposed one on another, is improved by controlling the scan start timings of the main scan and the sub-scan by an image exposure unit, which forms an image on the image carrying body by a laser beam, the phase of the polygon mirror for scanning by the laser beam, or the position of the mirror for guiding the laser beam to the image carrying body.

In color electrophotography-based image forming apparatus of the type in which a plurality of image forming units including the image carrying bodies (photoreceptor drums) are provided for each color, it is a common practice that the image forming units may be replaced with new ones for each color, as disclosed in Japanese Utility Model laid-open No. 29148/1987. In some image forming apparatus, a replaceable system is employed in which the respective color image forming units are fixed to a single image forming unit positioning member, and the positioning member is then mounted on the main body, as disclosed in Japanese patent laid-open No. 36346/1996. Either system needs the replacement of several number of image forming units. Accordingly, this fact remarkably increases a mental strain of the user when he or she replaces the an image forming unit with another image forming unit. In a case where the image forming units are assembled into a unit and the support shafts of the image carrying bodies are positioned to the frame of the unit, the following problem arises: an accuracy of positioning the writing unit, the intermediate transfer unit for superimposing the color component images, and the image carrying bodies is deteriorated. In the image forming unit as disclosed in Japanese patent laid-open No. 78686/1998, the position accuracy of the laser-based writing unit and the image carrying bodies, and the position accuracy of the image carrying bodies and the image carrying body transfer drums which are in contact with the image carrying bodies greatly affect the accuracy of color misregistration. A problem of color misregistration arises in the image forming unit disclosed.

In most cases, the color registration of the apparatus main body is adjusted at a factory before it is delivered. When the image forming unit greatly affects the color misregistration, the adjustment equivalent to that at the initial state of the product at the factory is required in a maintenance work, e.g., the user replaces the image forming unit with a new one, after the apparatus is commercially supplied. In this case, to lessen the user's load, some means to automatically adjust the color misregistration may be used additionally. A color misregistration adjusting technique is present which detects the result of superimposing the color component images by some means, and feeds back the detection result for adjustment. The technique needs a high accuracy detecting mechanism and adjusting mechanism. This fact results in remarkable increase of the apparatus cost. The color misregistration may be adjusted in a manner that the image formed is output, and a quantity of a color misregistration of the image is detected by the eye, and a color misregistration correction quantity based on the detection is input to the apparatus main body. In this approach, the adjusting accuracy is poor, however.

A color misregistration arises from a position accuracy of the image carrying bodies support shafts and a laser beam position accuracy of a ROS. A high position accuracy of several tens $\mu$m is required for satisfying a tolerable level. It is actually difficult to satisfy the requirement of such a high position accuracy, and a common practice is to adjust the timings of the laser beams for the purpose of preventing color misregistration. Accordingly, in order to make the user free from those sequential adjusting steps when he replaces the image forming unit including the photoreceptor drum with a new one, it is necessary to exactly position and fix the image carrying bodies support shafts to the apparatus main body.

Before delivery from a factory, color misregistration is adjusted, in both the main scan and sub-scan directions of the ROS, on the basis of the image as finally printed out and according to the writing timings of the ROS and the readout timing clock frequency. The color misregistration depends greatly on the position accuracy of the photoreceptor drums. In spite of this fact, its adjustment is carried out by controlling electrical times, not by adjusting those positions. For this reason, it is necessary to accurately position the image carrying bodies support shafts to the main body.

The conventional image forming apparatus employs a C-path transport system in which a sheet transporting path is curved shaped like a C when viewed from the side of the apparatus. The C-path transport system has the following advantages, and is employed in particular by small desk-top printers.

1) The sheet transport path is short, a time taken from sheet feeding to sheet discharging is short, and the image forming is highly efficient.
2) If the sheet feeding direction is placed in the front surface of the image forming apparatus, the sheet transporting path is opened to the user side. Accordingly, a jam removal operation is easy.
3) The operation of replacing the image forming unit may be performed by opening the front cover or the upper cover. A space occupied by the image forming apparatus when the cover is opened is small.

In the color tandem apparatus containing a plurality of image forming units (photoreceptor drums), it is necessary to exactly position the image forming units (photoreceptor drums) to the main body in consideration of color misregistration or other problems. Further, the image forming units must be constructed so as to allow the user to replace them with other ones. In the C-path transport system, the image forming units are vertically arranged. Accordingly, in the structure where the image forming units are inserted into and removed from the main body in lateral directions parallel to the image carrying bodies support shafts or the unit is inserted into and removed from the main body in lateral directions parallel to the image carrying bodies support shafts as the sheet transporting directions, a space to allow the insertion and removal motions of the image carrying bodies in the image carrying bodies support shaft directions must be provided when taking into account the insertion and removal of the image forming units located in the lower part. Further, a cover opened for jam removal is different from a cover opened for the color tandem machine replacement, so that an advantage of restrictions on the machine installation space is impaired. For the insertion and removal of the image carrying bodies in the sheet transporting direction, an angle of the opening of the cover located on this side must be large, so that the apparatus installation space is large. A manual inserter, transporting rolls and the like are located upstream of a transfer section. If those are disposed at positions where the insertion/removal motion of the image forming unit located in the lower part is not hindered, the transporting distance is long, and the advantages of the C-path transport system is impaired. In Japanese patent laid-open No. 72983/1999, a plurality of image forming units, which are detachably attached to unit receivers formed in the apparatus main body, are inserted and removed horizontally or in lateral directions. Accordingly, the sheet transport path is long, and the advantages of the C-path transport is impaired.

In the image forming apparatus of the tandem type, a very expensive device is required to correct color misregistration of the apparatus after it is commercially supplied. If such an expensive device is not used, color misregistration adjustment will be difficult and its accuracy is extremely deteriorated.

Accordingly, an object of the present invention is to solve the above problems, to accurately position the image carrying bodies to prevent color misregistration, to lessen the mental strain of the user in maintenance work, and to prevent the charging performance and the developing performance of the image carrying bodies from being degraded, and to provide an image forming apparatus of good electric power feeding performance.

Another object of the present invention is to provide a technique to realize a mechanism for the C-path transport system, which is advantageously applied to a small printer, in a color tandem apparatus. In this case, extreme care must be exercised so as not to lower the color misregistration accuracy and not to deteriorate the operability.

Further subjects of the invention are:

(1) To find such an insertion/removal direction as not to hinder the insertion/removal motion of the image forming unit.
(2) To assemble the image forming units into a unit assembly and hence to improve the operability at the time of inserting and removing the image forming units.
(3) To construct such a structure as not to deteriorate the color misregistration.
(4) To reduce the apparatus cost and size by guiding the image carrying bodies support shafts.
(5) To save the widthwise space by commonizing the configuration of the apparatus main body.
(6) To prevent erroneous operations.

SUMMARY OF THE INVENTION

The invention is made to solve the problems. In accordance with a first aspect of the present invention, there is provided an image forming apparatus having an image forming unit, in which the image forming unit includes a plurality of image carrying bodies, the image forming unit is a unit assembly, and the unit assembly is formed to be detachable from a main body of the image forming apparatus. The term "unit assembly" means an aggregation of the individual units of the image forming apparatus, which are arranged such that those units exhibit their functions. The unit assembly may be handled as one component.

The plurality of image carrying bodies may be a plurality of latent image carrying bodies or a plurality of intermediate transfer members. The plurality of image carrying bodies may also be a plurality of latent image carrying bodies and one intermediate transfer member. Further, the plurality of image carrying bodies may be one latent image carrying body and one intermediate transfer member or a plurality of latent image carrying bodies and a plurality of intermediate transfer members. In a preferred embodiment, the unit assembly formed to be detachable from the main body of the image forming apparatus is disposed in the main body of the image forming apparatus by downwardly moving the unit assembly. The preferred embodiment involves the following construction: A portion on which the unit assembly is placed is pulled out of the image forming apparatus main body in the substantially horizontal direction, and in this state the unit assembly is put on a unit assembly placement location by downwardly moving the unit assembly, and then the pulled out one is returned to its original position. With such a construction, the portion includes the plurality of image carrying bodies, so that the weight of it is increased. As a result, the insertion or installation of the unit assembly is easy.

The unit assembly may include a handle on an upper surface thereof. This feature makes it easier to install the unit assembly into the image forming apparatus main body. In this case, the unit assembly formed to be detachable from the main body of the image forming apparatus may be disposed in the main body of the image forming apparatus by a single action of downwardly moving the unit assembly. This feature is desirable since it remarkably reduces a mental strain of the user when he replaces the unit assembly with another unit assembly.

A positioning member for positioning the unit assembly when the unit assembly is disposed in the main body of the image forming apparatus may be integrally molded. With this feature, the unit assembly may be accurately positioned, to thereby effectively prevent color misregistration. In that case, the image forming apparatus may further have an exposure unit for forming a latent image on the image carrying body, in which the exposure unit is supported by the positioning member integrally molded. The plurality of image carrying bodies and the exposure unit are supported by the common positioning member. Accordingly, color misregistration may be prevented accurately. In this case, the positioning member and the housing of the exposure unit may be made of the same material. The linear expansion coefficients of the positioning member and housing are equal to each other. The occurrence of the color misregistration, caused by the influence of temperature of an ambience in which the image forming apparatus is placed, may be suppressed effectively. A material of the positioning member and housing is preferably a material formed by mixing glass fiber into polycarbonate, for example.

Preferably, in the image forming apparatus, the image carrying bodies are supported by the image carrying body supporting members, at least one of the supporting members is minutely movably supported by a frame of the unit assembly with a gap, and when the unit assembly is disposed in the main body of the image forming apparatus, the supporting member is positioned and fixed to a housing of the main body of the image forming apparatus. More preferably, in the image forming apparatus, the image carrying bodies are supported by the image carrying body supporting members, at least one of the supporting members is minutely movably supported by a frame of the unit assembly with a gap, and when the unit assembly is disposed in the main body of the image forming apparatus, the positioning member positions and fixes the supporting member. The unit assembly preferably includes a plurality of developing units.

In the image forming apparatus, it is preferable that the developing units are pressed against surfaces of the image carrying bodies to be positioned so that predetermined gaps are present between the developing units and the surfaces of the image carrying bodies.

In the image forming apparatus, the developing units receive drive forces from a developing-unit driving device located in the main body of the image forming apparatus, the developing-unit driving device is different from image carrying body driving device, and in the developing unit, gears are arranged such that a tangential load of the gear, which operates when the developing-unit driving device is driven, does not produce such a component of force as to cancel a pressing force applied to a drum surface of each developing unit.

The unit assembly may include a plurality of charging units. In the image forming apparatus, the charging units are positioned and fixed to shafts of the image carrying bodies, the charging units have mechanisms which are minutely movably supported on a frame of the unit assembly with a gap, and the mechanisms prevent the charging units from turning in a circumferential direction of the image carrying bodies.

The image carrying bodies may be earthed and include ground lines, which interconnect shafts of the image carrying bodies by way of electrically conductive elastic members.

The image forming apparatus may further have a charging device which feeds electric power to a charging unit from outside of the unit assembly by way of a frame of the unit assembly, in which the charging device includes an electrically conductive elastic member which couples a conductive member for feeding electric power to the charging unit located on a frame of the unit assembly and a charging-unit supporting member.

The intermediate transfer members may be cylindrical intermediate transfer drums. The intermediate transfer drums may include a primary transfer drum onto which an image is transferred from the image carrying body and a secondary transfer drum onto which the image is transferred from the primary transfer drum and the secondary transfer drum may be a drum for transferring the image thereon onto a sheet of paper.

Furthermore, the intermediate transfer drums may be supported by intermediate transfer drum shafts, at least one of the intermediate transfer drum shafts may be minutely movably supported by a frame of the unit assembly with a gap, and the shafts of the intermediate transfer drums have mechanisms for positioning and fixing the shafts of the intermediate transfer drums to a housing of a main body of the image forming apparatus when the unit assembly is installed in the main body of the image forming apparatus.

The unit assembly may have four image carrying body drums, two primary intermediate transfer drums, and one secondary intermediate transfer drum. Preferably, the shaft of the secondary intermediate transfer drums is press-fitted into the frame of the unit assembly.

According to another aspect of the present invention, there is provided an image forming apparatus having an image forming unit, in which the image forming unit includes a plurality of image carrying bodies, the image forming unit is a unit assembly in which axial lines of the plurality of image carrying bodies are arranged parallel to one another in a plane containing the axes, the unit assembly is detachable from a main body of the image forming apparatus in a direction of a line perpendicular to the axes in the axes-contained plane.

The image carrying bodies are preferably supported by a single frame. Each of the image carrying bodies may be positioned to the main body of the image forming apparatus. The main body may have first guides for guiding ends of image carrying body support shafts to position the unit assembly to the main body of the image forming apparatus. The first guides may include oblique branch paths for guiding the image carrying body support shafts to fixing positions.

At least one protrusion, which is different from the image carrying body support shafts, may be provided on a frame of the unit assembly and second guides for guiding the protrusion may be provided on a housing of the main body of the image forming apparatus. With this feature, the unit assembly is inserted into or removed from the image forming apparatus main body, while being guided by the first and second guides. Accordingly, the inserting and removing operations of the unit assembly are free from its inclination and twisting.

The image carrying bodies may be photoreceptor drums or may be intermediate transfer drums and photoreceptor drums. In the image forming apparatus of the invention, a sheet feeding portion may be located at a lower position, a sheet discharging portion may be located at an upper position, a direction in which a transfer member is transported at the time of image transferring may be in a range of from 45° to 90° with respect to a horizontal direction, and the axes-contained plane may be a substantially vertical plane with respect to the horizontal direction. The reason why the transporting direction of the transfer member is set to be in a range of from 45° to 90° is that an ideal transporting direction angle is as close to the vertical direction as possible, but at least 45° or larger is desirable for the transporting direction.

DETAILED DESCRIPTION OF PREFERRED EMBODIMENTS

Figure 2:
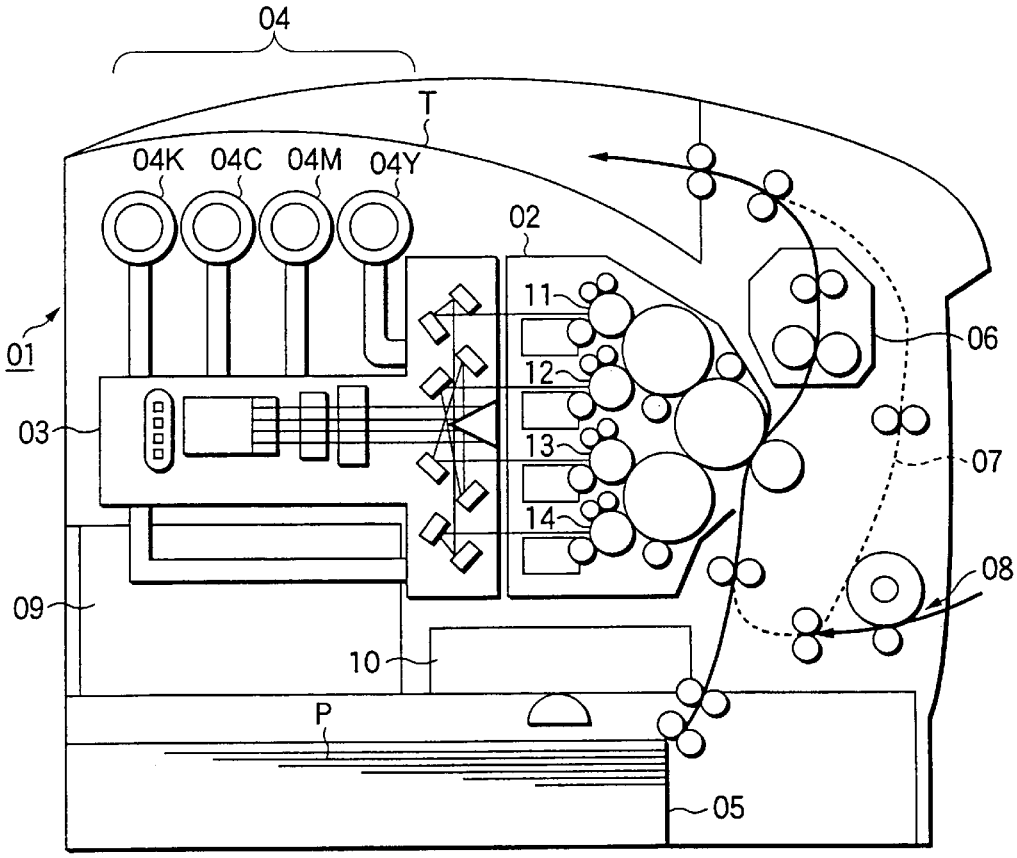
FIG. 2 is a diagram showing a full color printer of a tandem type which is one form of an image forming apparatus of an embodiment according to the invention.
Figure 3:
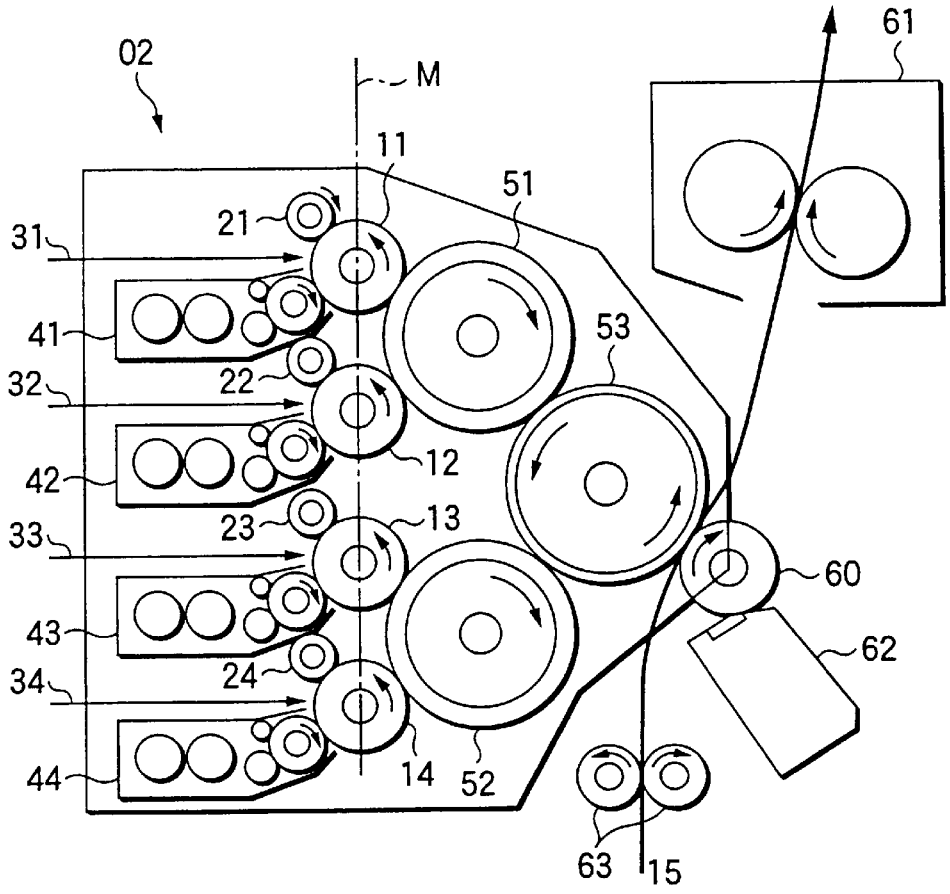
FIG. 3 is a diagram showing a key portion of the image forming apparatus of the embodiment according to the invention.

The preferred embodiments of the present invention will be described with reference to the accompanying drawings. FIG. 2 is an explanatory diagram showing an image forming apparatus of an embodiment according to the invention, and in the figure, the image forming apparatus takes the form of a full color printer of a tandem type. FIG. 3 is a diagram showing a print head device 02 of the tandem type full color printer shown in FIG. 2. The print head device 02, as will be described hereunder, is an embodiment of the invention constructed such that an image forming unit including a plurality of image carrying bodies is formed as a unit assembly. Arrows in FIG. 3 indicate the rotating directions of the members.

As shown in FIG. 2, the print head device 02 as an image forming unit for forming a full color image is accommodated in a main body 01 of the tandem type full color printer. In the embodiment, the print head device 02 includes four photoreceptor drums 11, 12, 13, 14 serving as image carrying bodies. A ROS (raster output scanner) 03 as an exposure unit optically forms images on the four photoreceptor drums 11, 12, 13, 14. Developing units 41, 42, 43, 44 of different colors are provided in association with the four photoreceptor drums 11, 12, 13, 14 as the image carrying bodies contained in the print head device 02 (See FIG. 3.) As shown in FIG. 2, four toner cartridges 04 (04Y, 04M, 04C, 04K) supply color toners to developing units 41, 42, 43, 44, respectively. A sheet cassette 05 stores recording sheets P, and supplies the recording sheets P as recording mediums to the print head device 02. A fixing unit 06 performs a fixing process on a recording sheet P to which a toner image was transferred from the print head device 02. A both-side transport path 07 is provided which transports a recording sheet P one side of which has an image fused and fixed by the fixing unit 06, again to a transfer section of the print head device 02 in a state that the recording sheet P is inverted. A manual inserting device 08 is used for feeding a desired recording sheet P to the main body 01, from the outside of the main body 01. A controller 09 for controlling operations of the printer and electric circuitry 10, which contains an image processing circuit for image-processing image signals and a high-voltage power supply circuit and the like, are provided. In FIG. 2, a discharge tray T is provided for discharging the recording sheets P having images formed thereon, and is disposed in an upper part of the main body 01 in an integral form.

The ROS 03 as the exposure unit includes four semiconductor lasers, which are driven to be turned on according to image data corresponding to the colors of yellow (Y), magenta (M), cyan (C), and black (K), and an (f-θ) lens, a polygon mirror or a plurality of reflecting mirrors and others, which function to deflect, for scanning, four laser beams (designated by 31, 32, 33, 34 in FIG. 3) emitted from those four semiconductor lasers.

The print head device 02, as shown in FIG. 3, includes charging rolls 21, 22, 23, 24 for primary charging and developing units 41, 42, 43, 44. The charging rolls 21, 22, 23, 24 contact respectively with the photoreceptor drums 11, 12, 13, 14 serving as the image carrying bodies. The developing units 41, 42, 43, 44 develop electrostatic latent images, which are formed on the photoreceptor drums 11, 12, 13, 14 by using laser beams 31, 32, 33, 34 of the respective colors emitted from the ROS (exposure unit) 03 (FIG. 2), into color toner images. A first primary intermediate transfer drum (intermediate transfer member) 51 serving as an image carrying body is in contact with photoreceptor drums 11 and 12 of the four photoreceptor drums 11, 12, 13, 14. A second primary intermediate transfer drum (intermediate transfer member) 52 as another image carrying body is in contact with the other two photoreceptor drums 13 and 14. A secondary intermediate transfer drum (intermediate transfer member) 53 as an image carrying body is in contact with both first and second primary intermediate transfer drums 51 and 52. A final transfer roll 60 is in contact with the secondary intermediate transfer drum 53. The image forming unit (print head device) 02 includes those members mentioned above therewithin as its key portions.

As shown in FIG. 3, the photoreceptor drums 11, 12, 13, 13 are disposed in parallel at fixed intervals, and four axes of those drums are contained in a plane "M". The first primary intermediate transfer drum 51 and the second primary intermediate transfer drum 52 are disposed such that both axes of them are in parallel with the axes of the photoreceptor drums 51, 52, 11, 12, 13, 14, and those drums are plane symmetrical with respect to a predetermined symmetry plane. The secondary intermediate transfer drum 53 is disposed such that its axis is in parallel with the axes of the photoreceptor drums 11, 12, 13, 14.

Color signals based on image data are rasterized and are input to a laser optical unit. In the laser optical unit, the laser beams 31, 32, 33, 34 of the colors cyan (C), magenta (M), yellow (Y), and black (K) are modulated according to the input image data of the respective colors, and the modulated beams are irradiated onto the photoreceptor drums 11, 12, 13, 14 of the corresponding respective colors. An image forming process, based on the known electrophotography, is performed around the photoreceptor drums 11, 12, 13, 14. A photoreceptor drum, which uses an OPC photoreceptor of 20 mm in diameter, is used for each of the photoreceptor drums 11, 12, 13, 14. The photoreceptor drums 11, 12, 13, 14 are driven, by drive devices for rotary bodies, to rotate at a surface speed of 95 mm/sec, for example. The surfaces of the photoreceptor drums 11, 12, 13, 14 are charged to about −300V, for example, by applying a DC voltage of about −840V to the charging rolls 21, 22, 23, 24 serving as contact-type charging devices. The charging devices of the contact-type are classified into a roll type charging device, a film type charging device, a brush type charging device, and others. Of those charging devices, any type of charging device 02 may be used for the print head device of the invention. A charging roll, which is generally used in the electrophotographic machine recently, is employed in this embodiment. The surfaces of the photoreceptor drums 11, 12, 13, 14 may be charged by applying only DC voltage or "DC+AC voltages" to the surface thereof.

To form electrostatic latent images on the surfaces of the photoreceptor drums 11, 12, 13, 14, those drums 11, 12, 13, 14 are charged, and the laser optical units emit the color laser lights onto the drum surfaces, whereby electrostatic latent images of those colors are formed on the drum surfaces, respectively. When the electrostatic latent images are written onto the photoreceptor drums 11, 12, 13, 14 by the laser optical units, a surface potential at the exposed part of each drum 11, 12, 13, 14 is reduced in value to a value of −60V or smaller. The electrostatic latent images of the respective colors formed on the surfaces of the photoreceptor drums 11, 12, 13, 14 are developed into toner images of the respective colors on the photoreceptor drums 11, 12, 13, 14 by the developing units 41, 42, 43, 44 of the corresponding colors, whereby those latent images are visualized.

In this embodiment, a two-component developing system of a magnetic brush contact-type is employed for each of the developing units 41, 42, 43, 44, but any other suitable developing system, e.g., a non-contact type developing system, may be used instead. The developing units 41, 42, 43, 44 are respectively filled with developers containing carriers and different color toners of cyan (C), magenta (M), yellow (Y), and black (K). When the developing units 41, 42, 43, 44 are supplied with toners from toner supplying devices, the supplied toners, together with the carriers, are sufficiently agitated by an auger, whereby the toners are friction-charged. A magnet roll is fixedly disposed within a developing roll. The magnet roll contains a plurality of magnetic poles, which are angularly spaced from one another at predetermined angles. Developer is transported to a position near the surface of each developing roll by a paddle for transporting the developer. A quantity of the developer is regulated by a developer-quantity regulating member. In the embodiment, the regulated quantity of the developer is 30 to 50 g/m$^2$. A quantity of charge of the charged toner present on the developing roll is about within a range of −20 to 35 $\mu$C/g.

The toner supplied onto the developing roll takes the form of a magnetic brush consisting of the carriers and the toner, by a magnetic force of the magnet roll.

The magnetic brush is in contact with the photoreceptor drums 11, 12, 13, 14. The electrostatic latent images formed on the photoreceptor drums 11, 12, 13, 14 are developed into toner images by using toners on the developing rolls by applying AC and DC bias voltages to the developing rolls. In this way, the toner images are formed. In the embodiment, the AC bias voltage is specified by 4 kHz and 1.5 kVpp and the DC bias voltage is about −230V.

The color toner images formed on the photoreceptor drums 11, 12, 13, 14 are electrostatically and secondarily transferred onto the first primary intermediate transfer drum 51 and the second primary intermediate transfer drum 52. The toner images of cyan (C) and magenta (M) formed on the photoreceptor drums 11 and 12 are transferred onto the first primary intermediate transfer drum 51. The toner images of yellow (Y) and black (K) formed on the photoreceptor drums 13 and 14 are transferred onto the second primary intermediate transfer drum 52. Accordingly, a double superimposed color image is formed on the first primary intermediate transfer drum 51. The double superposed image consists of a mono-color image transferred from the photoreceptor drum 11 or 12 and a duplex color image consisting of images of the two colors transferred from both the photoreceptor drums 11 and 12. A mono-color image and a duplex color image are likewise transferred also on the second primary intermediate transfer drum 52, from the photoreceptor drums 13 and 14.

Surface potential necessary for electrostatically transferring the toner images from the photoreceptor drums 11, 12, 13, 14 to the first and second primary intermediate transfer drums 51 and 52, is within +250 to 500V. This surface potential is selected to have an optimum value depending on a charging state of toner, and atmospheric temperature and humidity. The atmospheric temperature and humidity may be simply obtained by detecting a resistance value of a member whose resistance value varies with the atmospheric temperature and humidity. When the charge quantity of the toner is within the range of −20 to 35 μC/g as described above and the apparatus is placed in ambient conditions of normal temperature and humidity, it is preferable that the surface potential values of the first and second primary intermediate transfer drums 51 and 52 are at about +380V.

The first and second primary intermediate transfer drums 51 and 52 used in this embodiment are each designed such that the outside diameter is 42 mm, and the resistance values are about 100Ω. The first and second primary intermediate transfer drums 51 and 52 are cylindrical rotary bodies having flexible or elastic surfaces each consisting of a single or multiple layers. Generally, a metal pipe made of Fe or Al as a metal core is covered with a low-resistance elastic rubber layer ($R=10^2$ to $10^3\Omega$), which is made typically of conductive silicon rubber and has a thickness of about 0.1 to 10 mm. Further, the outermost surface of the first and second intermediate transfer drums 51 and 52 is formed with a release layer ($R=10^5$ to $10^9\Omega$) of 3 to 100 μm thick, which is typically made of fluorine rubber into which fluorine plastic fine particles are dispersed, the release layer being bonded by an adhesive (primer) of silane coupling agent. In forming the drum surface, the important factors are a resistance value and a releasability of the surface. a suitable material may be used if a release layer made of the material is about $10^5$ to $10^9\Omega$ ($R\approx10^5$ to $10^9\Omega$) in resistance and has a good releasability.

In this way, the toner images formed on the first and second primary intermediate transfer drums 51 and 52 are electrostatically and secondarily transferred onto the secondary intermediate transfer drum 53. Accordingly, a final image is formed on the secondary intermediate transfer drum 53.

A surface potential value of the secondary intermediate transfer drum 53 necessary for electrostatically transferring the toner images from the first and second primary intermediate transfer drums 51 and 52 onto the secondary intermediate transfer drum 53 is within a range of about 600 to 1200V. This surface potential is selected to have an optimum value depending on charging state of the toner, atmospheric temperature, and humidity as in the case of transferring the toner images from the photoreceptor drums 11, 12, 13, 14 onto the first and second primary intermediate transfer drums 51 and 52. It is the potential difference between the first and second primary intermediate transfer drums 51 and 52 and the secondary intermediate transfer drum 53 that is required for transferring the toner images. Therefore, the surface potential of the secondary intermediate transfer drum 53 must be selected in accordance with the surface potentials of the first and second primary intermediate transfer drums 51 and 52. When the charge quantity of the toner is within −20 to 35 μC/g as described above, when the apparatus is placed in ambient conditions of normal temperature and normal humidity, and when the surface potential of the first and second primary intermediate transfer drums 51 and 52 is about +380V, the surface potential of the secondary intermediate transfer drum 53 is preferably selected to be about +880V, viz., the potential difference between the secondary intermediate transfer drum 53 and the first and second primary intermediate transfer drums 51 and 52 are preferably selected to be at about +500V.

The secondary intermediate transfer drum 53 used in this embodiment, is designed to have an outside diameter of 42 mm, which is equal to that of the first and second primary intermediate transfer drums 51 and 52, and to have a resistance value of about $10^{11}\Omega$. The secondary intermediate transfer drum 53 is also a cylindrical rotary body having a flexible or elastic surface consisting of a single or multiple layers. Generally, a metal pipe made of Fe or Al as a metal core is covered with a low-resistance elastic rubber layer ($R=10^2$ to $10^3\Omega$), which is made typically by conductive silicon rubber, and has a thickness of about 0.1 to 10 mm. Further, the outermost surface of the secondary intermediate transfer drum 53 is formed with a release layer ($R=10^5$ to $10^9\Omega$) of 3 to 100 μm thick, or a release layer of good releasability, which is typically made of fluorine rubber into which fluorine plastic fine particles are dispersed, the release layer being bonded by an adhesive (primer) of silane coupling agent. There, the resistance value of the secondary intermediate transfer drum 53 must be selected to be larger than that of the first and second primary intermediate transfer drums 51 and 52. Otherwise, the secondary intermediate transfer drum 53 charges the first and second primary intermediate transfer drums 51 and 52. And it is difficult to control the surface potential of the first and second primary intermediate transfer drums 51 and 52. Any suitable material may be used for the secondary intermediate transfer drum 53 if it satisfies the conditions mentioned above.

In turn, the toner image formed on the secondary intermediate transfer drum 53 is tertiarily transferred onto the recording sheet P, which travels along a sheet transporting path 15, by the final transfer roll 60. Following the sheet feeding process, the recording sheet P passes sheet transport rolls 63, and is fed to a nip area between the secondary intermediate transfer drum 53 and the final transfer roll 60. After the final transferring process, the final toner image formed on the recording sheet P is fused and fixed by a fixing unit 06. Here, a sequence of the image forming process steps ends.

The final transfer roll 60 is designed, for example, to have an outside diameter of 20 mm, and a resistance value of about $10^8\Omega$. The final transfer roll 60 is constructed such that a metallic shaft is covered with a coating layer made of urethane rubber or the like, and the result is further covered with a coating layer if necessary. An optimum voltage value applied to the final transfer roll 60 varies depending upon atmospheric temperature and humidity, and a kind of recording sheet P (resistance value) used, and it is approximately +1200 to +5000V. A constant current system is employed in the embodiment. Specifically, under ambient conditions of normal temperature and humidity, a transfer voltage (+1600 to 2000V), which is almost optimum in value, is obtained by feeding a current of about 6 μA.

In a cleaning process, residual toner left on the secondary intermediate transfer drum 53 is given a potential gradient, and gathered onto the final transfer roll 60, and finally is removed by a cleaning blade of a cleaning unit 62, which is in pressing contact with the surface of the final transfer roll 60.

Figure 1:
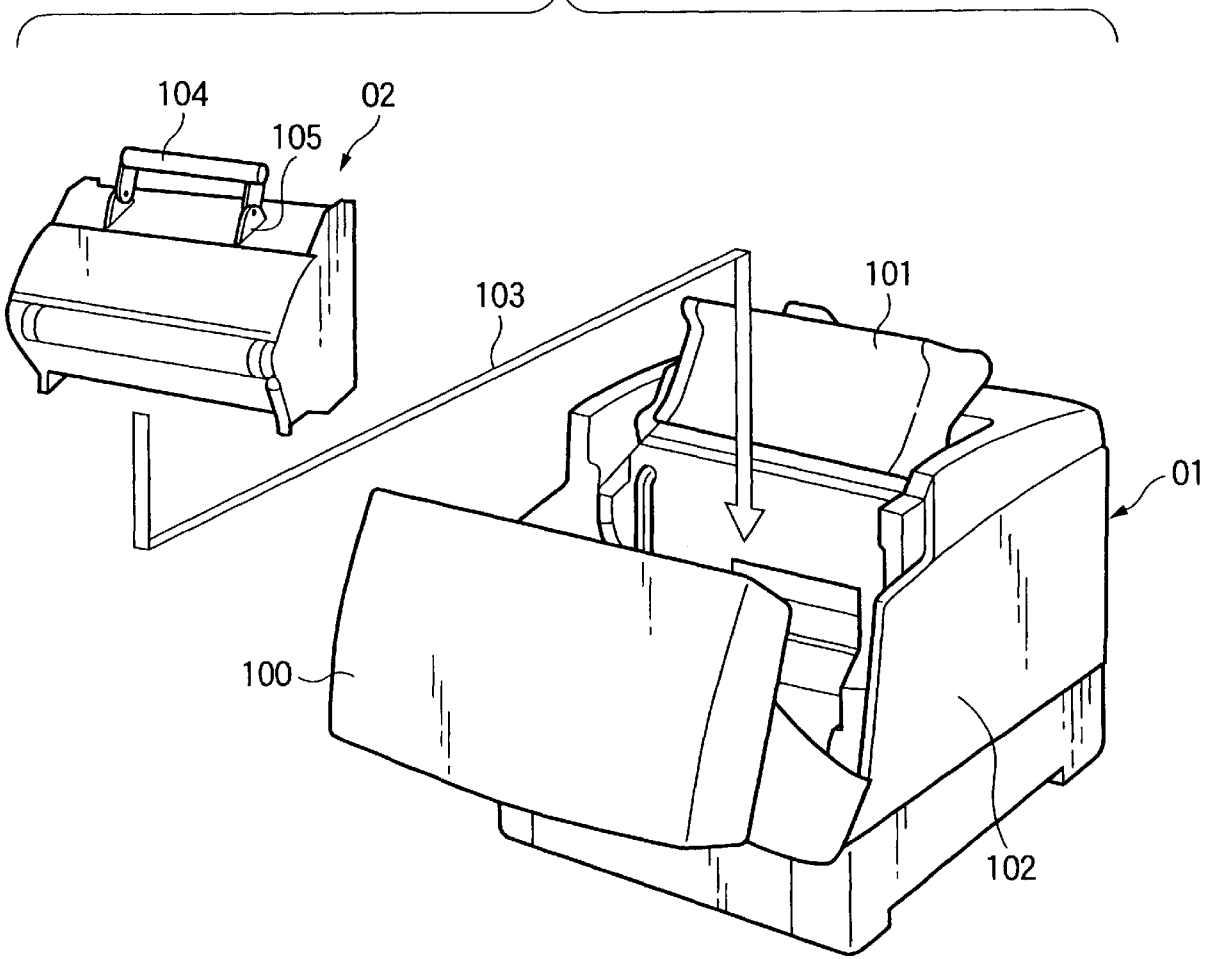
FIG. 1 a perspective view showing how to assemble the image forming unit as a unit assembly into an image forming apparatus of the invention.

FIG. 1 is a perspective view showing how to install the image forming unit 02 as assembled into a unit assembly, which forms the embodiment shown in FIG. 3, into the main body 01 of the color printer (image forming apparatus), which is an embodiment of the invention. The image forming unit 02 is formed as a unit assembly, as mentioned above. The image forming unit 02 may be inserted to and removed from the main body 01 of the image forming apparatus in a state that a front cover 100 and an upper cover 101 of the main body 01 of the image forming apparatus are opened. The image forming unit 02 as the unit assembly includes photoreceptor drums, developing units, charging units, and at least one image carrying bodies such as an intermediate transfer drum. Those units are assembled into an aggregation or a unit assembly in such an arrangement as to allow the individual units to exhibit their functions. This image forming unit 02 as the unit assembly includes a handle 104 attached to an upper surface bracket 105, as shown in FIG. 1. The image forming unit 02 may be handled like a single component as indicated by an arrow 103, and may be inserted into and removed from the main body 01 of the image forming apparatus by a single action.

Figure 7:
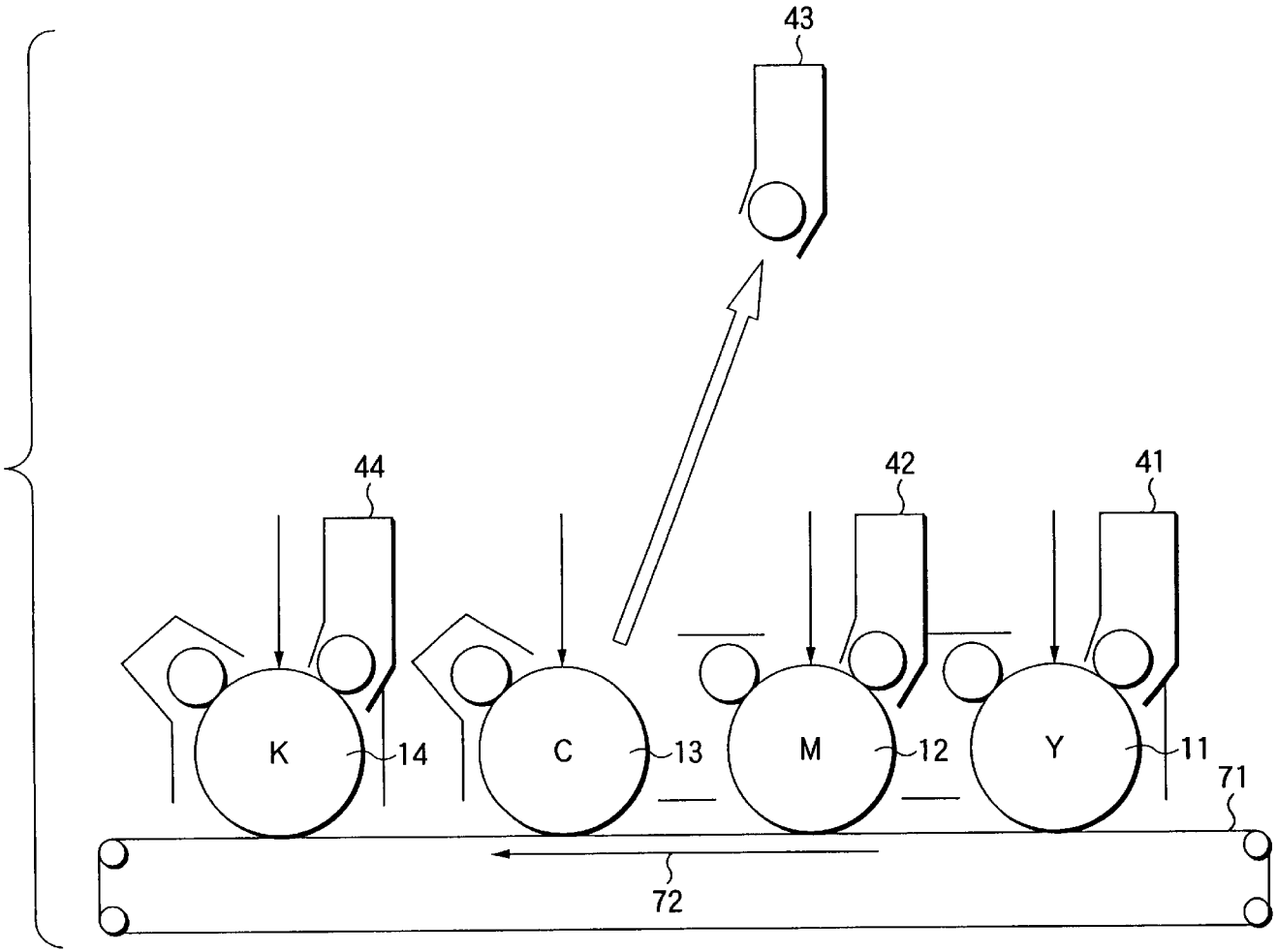
FIG. 7 is a diagram showing a key portion of the image forming apparatus of a further embodiment according to the invention.
Figure 8:
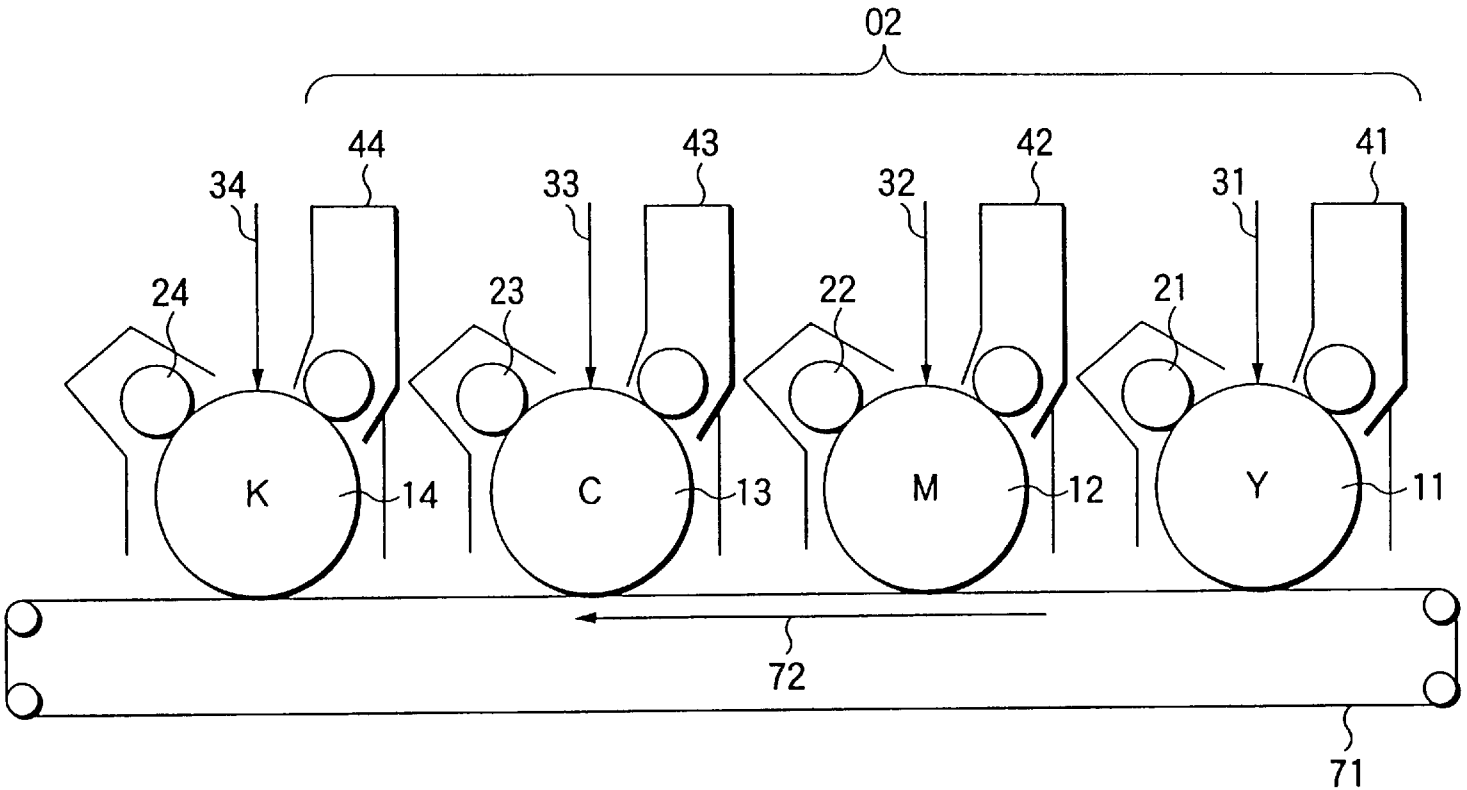
FIG.8 PRIOR ART
FIG. 8 is a diagram showing a key portion of a conventional image forming apparatus.

Another preferred embodiment, which is different from the embodiment of FIGS. 2 and 3, will be described with reference to FIGS. 4 through 7. FIG. 8 is an explanatory diagram showing a conventional tandem machine having an intermediate transfer belt 71. The photoreceptor drums 11, 12, 13, 14 as the image carrying bodies are horizontally and separately disposed as separate image forming units, which respectively include the charging rolls 21, 22, 23, 24 and the developing units 41, 42, 43, 44, and are in contact with the intermediate transfer belt 71 as the image carrying body which travels in the direction of an arrow 72. The intermediate transfer belt 71 sometimes serves as a sheet transporting belt.

Figure 4:
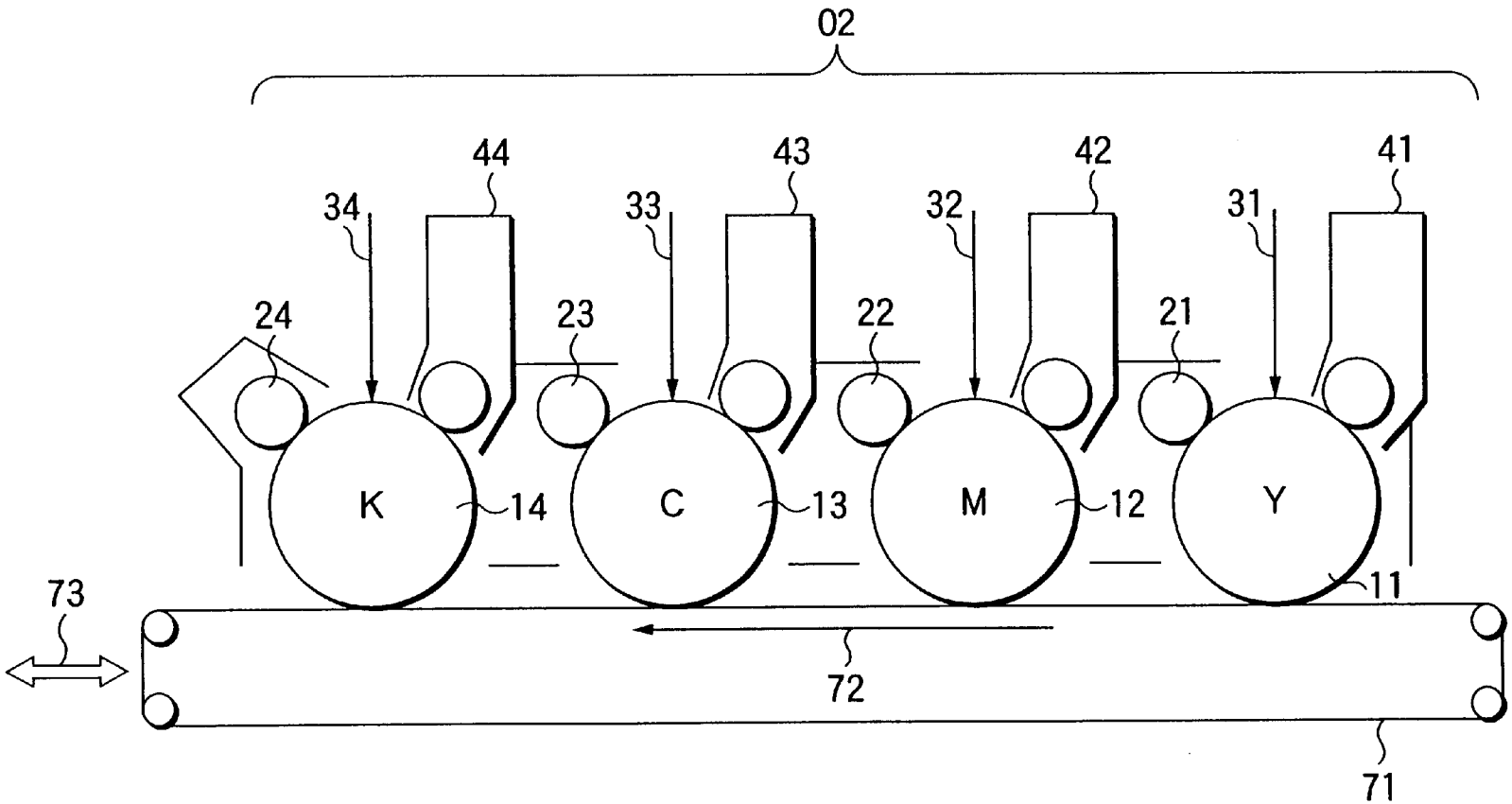
FIG. 4 is a diagram showing a key portion of the image forming apparatus of another embodiment according to the invention.

FIG. 4 is an explanatory diagram showing a tandem machine having the intermediate transfer belt 71, which is an embodiment of the invention. In the machine, the photoreceptor drums 11, 12, 13, 14 as the image carrying bodies of an image forming section form the image forming unit 02 as the unit assembly. The charging rolls 21, 22, 23, 24 and the developing units 41, 42, 43, 44 are assembled into the image forming unit 02. Those photoreceptor drums 11, 12, 13, 14 are irradiated with the laser beams 31, 32, 33, 34, respectively. The photoreceptor drums 11, 12, 13, 14 are in contact with the intermediate transfer belt 71 as the image carrying body which travels in the direction of an arrow 72 and transfer the toner images onto the intermediate transfer belt 71. The image forming apparatus may be constructed such that the intermediate transfer belt 71 is placed in a cassette (not shown), and the cassette is inserted into and removed out of the image forming apparatus in substantially horizontal directions as indicate by an arrow 73, and the image forming unit 02 as the unit assembly is inserted into and removed from the cassette from above.

Since a plurality of image forming sections are assembled into the unit assembly as the print head device 02, the weight of the print head device 02 is greatly increased when comparing with the case where a single image forming section is assembled into a unit assembly as the print head device 02. However, the handling of the print head device 02 is easy since the print head device 02 is put into the cassette from above. Since the plurality of the image forming sections are assembled into the unit assembly as the print head device or image forming unit 02, the image forming apparatus is reduced in size, and the mounting accuracy of the image carrying bodies (photoreceptor drums 11, 12, 13, 14) may easily be improved.

The inserting and removing directions of the cassette (not shown) may be perpendicular to a paper surface of the drawing, in addition to the direction of the arrow 73. In this case, the distance necessary for pulling out the cassette is short. With this feature, a cassette may be used which is designed so as to have a lessened strength when comparing with the case where the insertion/removal of the cassette is performed in the direction of the arrow 73. Further, the insertion/removal operation of the print head device 02 is also easy, and in this respect, good operability is ensured.

Figure 5:
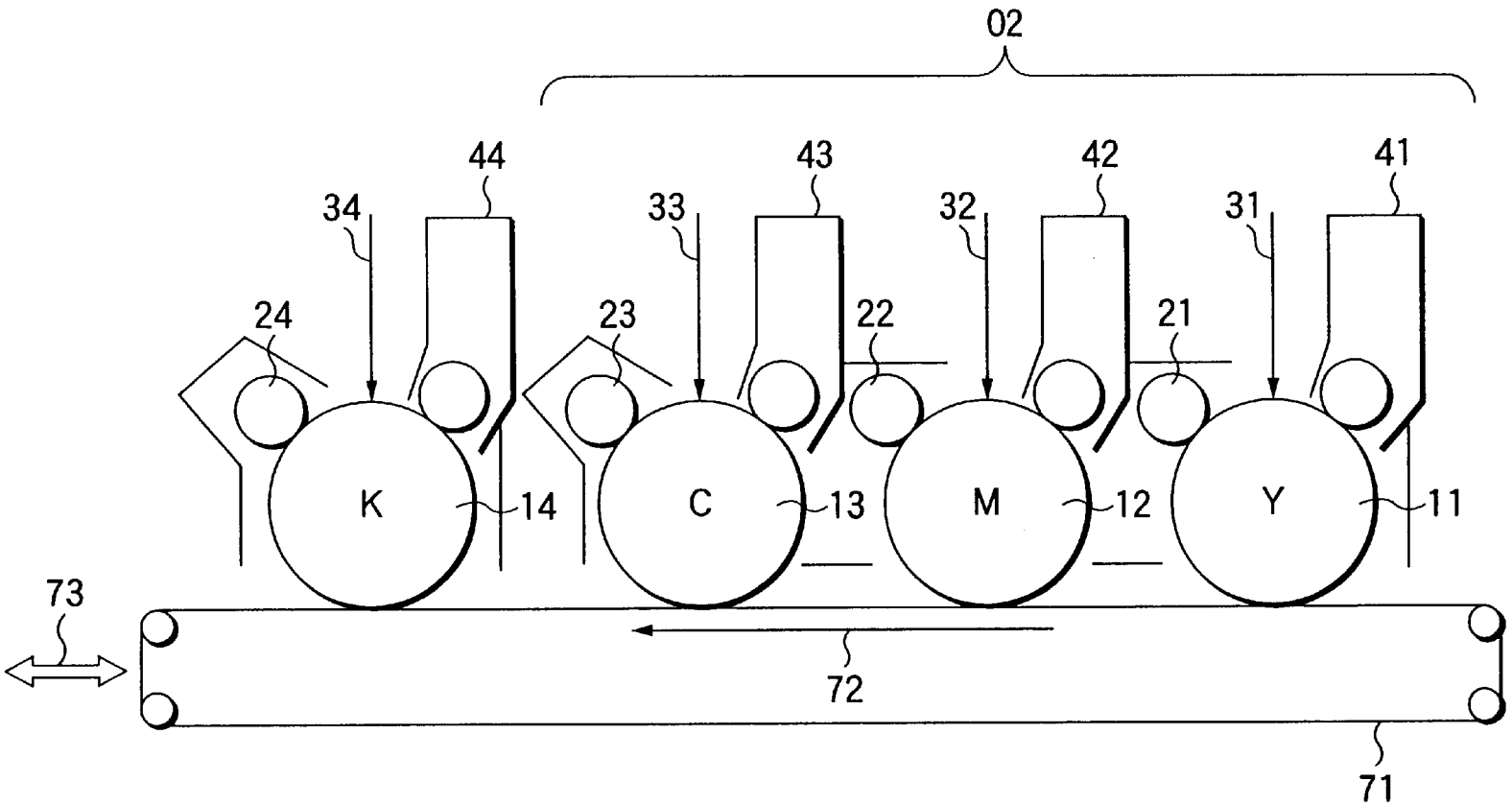
FIG. 5 is a diagram showing a key portion of the image forming apparatus of yet another embodiment according to the invention.

FIG. 5 is a diagram showing another image forming apparatus in which of the four photoreceptor drums 11, 12, 13, 14 as the image carrying bodies of the image forming sections, the three photoreceptor drums 11, 12, 13, and the charging rolls 21, 22, 23 and the developing units 41, 42, 43, which are associated with those drums 11, 12, 13, are assembled into an image forming unit or a print head device 02 of a unit assembly. If so arranged, the image forming section of black (K) color, which consumes much toner, functions as a separate unit. Therefore, it has an advantage that when the black (K) color image forming section is frequently replaced with another, the toners of the other color image forming sections will not be wasteful.

Figure 6:
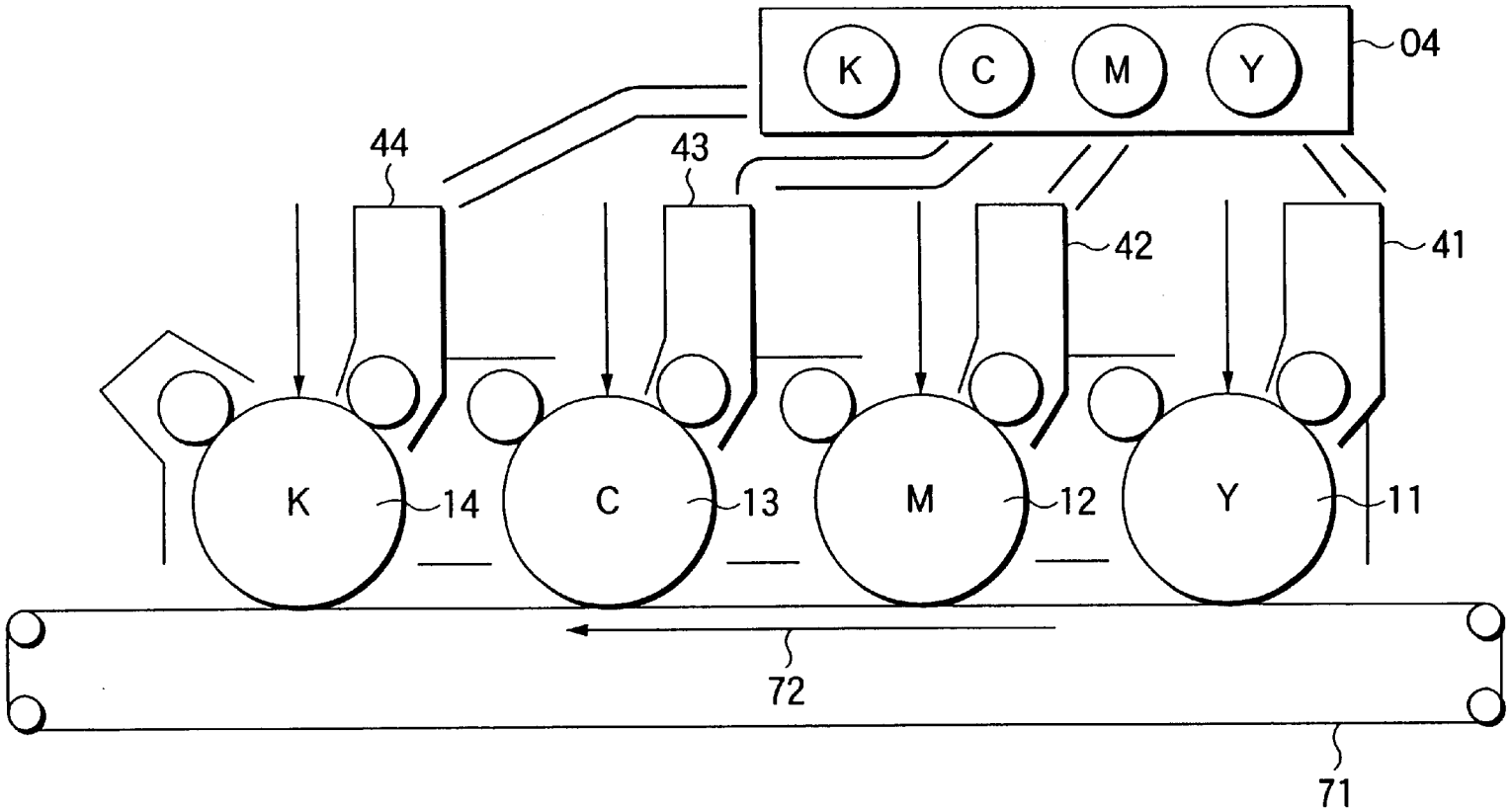
FIG. 6 is a diagram showing a key portion of the image forming apparatus of still another embodiment according to the invention.

FIG. 6 is a diagram showing yet another image forming apparatus in which toner cartridges 04 of a unit assembly are constructed as a separate unit. FIG. 7 is a diagram showing yet another image forming apparatus in which developing units 41, 42 and 43 of a unit assembly are removably mounted. In the figure, one developing unit 43 is typically illustrated. Where such an arrangement is used, the toner cartridge 04 and the developing unit 41, 42, 43 may be continuously used even if the replacement of the image forming section is performed. The toner cartridge 04 is constructed such that the replacement of the toner cartridge 04 is carried out for each of the colors of yellow (Y), magenta (M), cyan (C), and black (K). Design matters on the image transfer system, e.g., to determine the number of image carrying bodies used for the print head device 02 and to select the intermediate transfer belt 71 and the sheet transport belt for the intermediate transfer member, may be appropriately selected depending on a type, structure, and specifications of the image forming apparatus, and if required, its design may be modified. Those embodiments described above contribute to the reduction of the image forming apparatus in size, and the mounting accuracy of a photoreceptor drum is easily improved.

Figure 9:
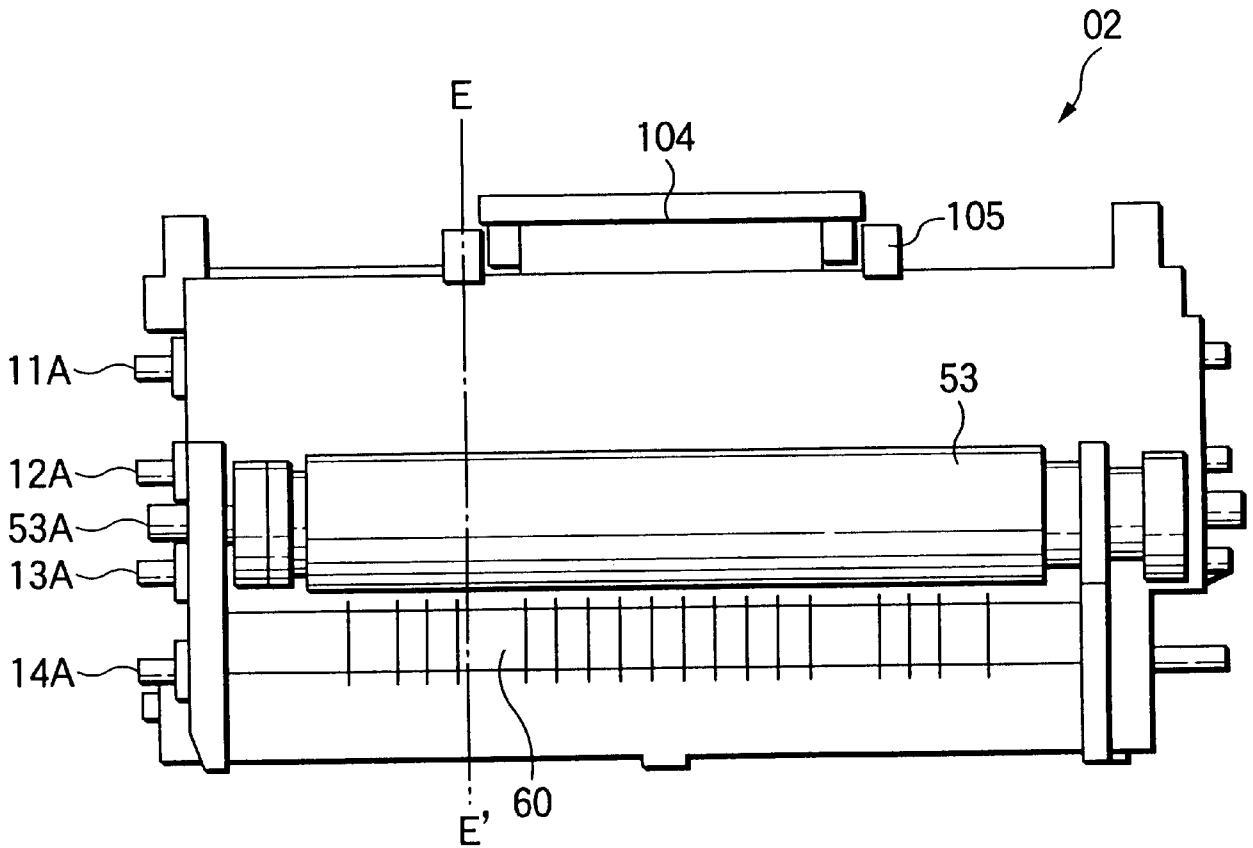
FIG. 9 is a front view showing an assembly unit.
Figure 10:
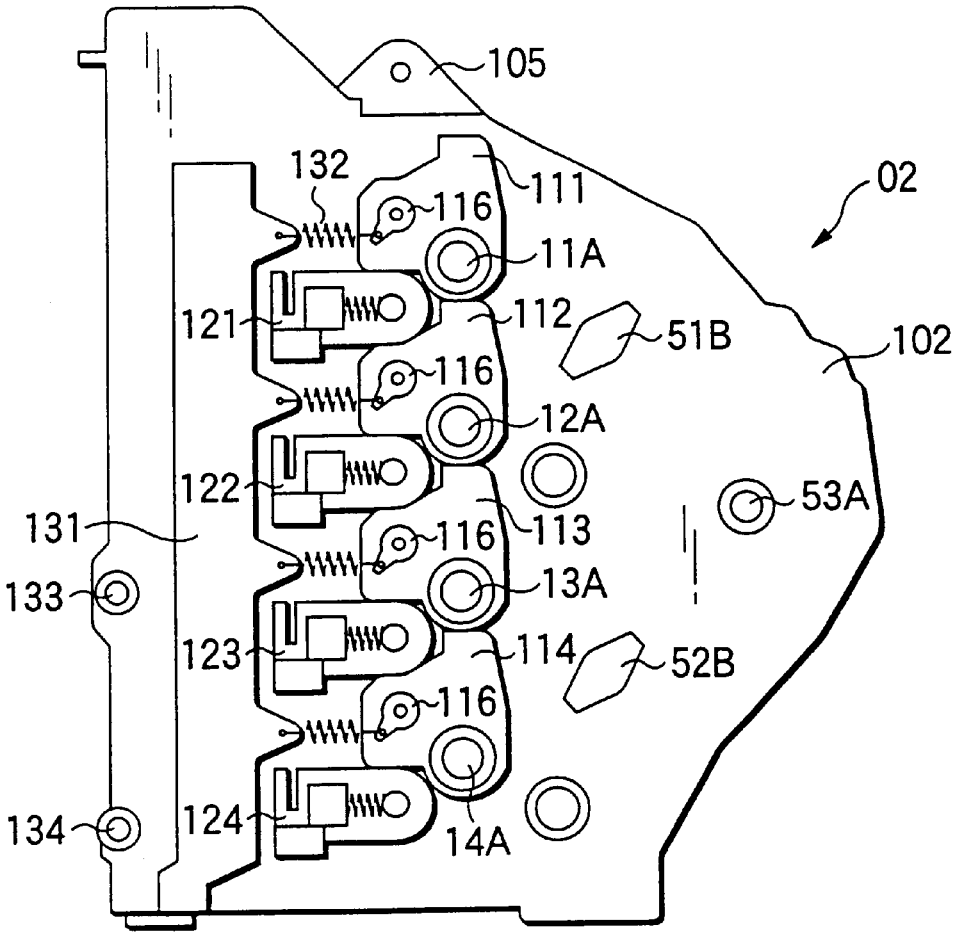
FIG. 10 is a left side view showing the assembly unit.
Figure 11:
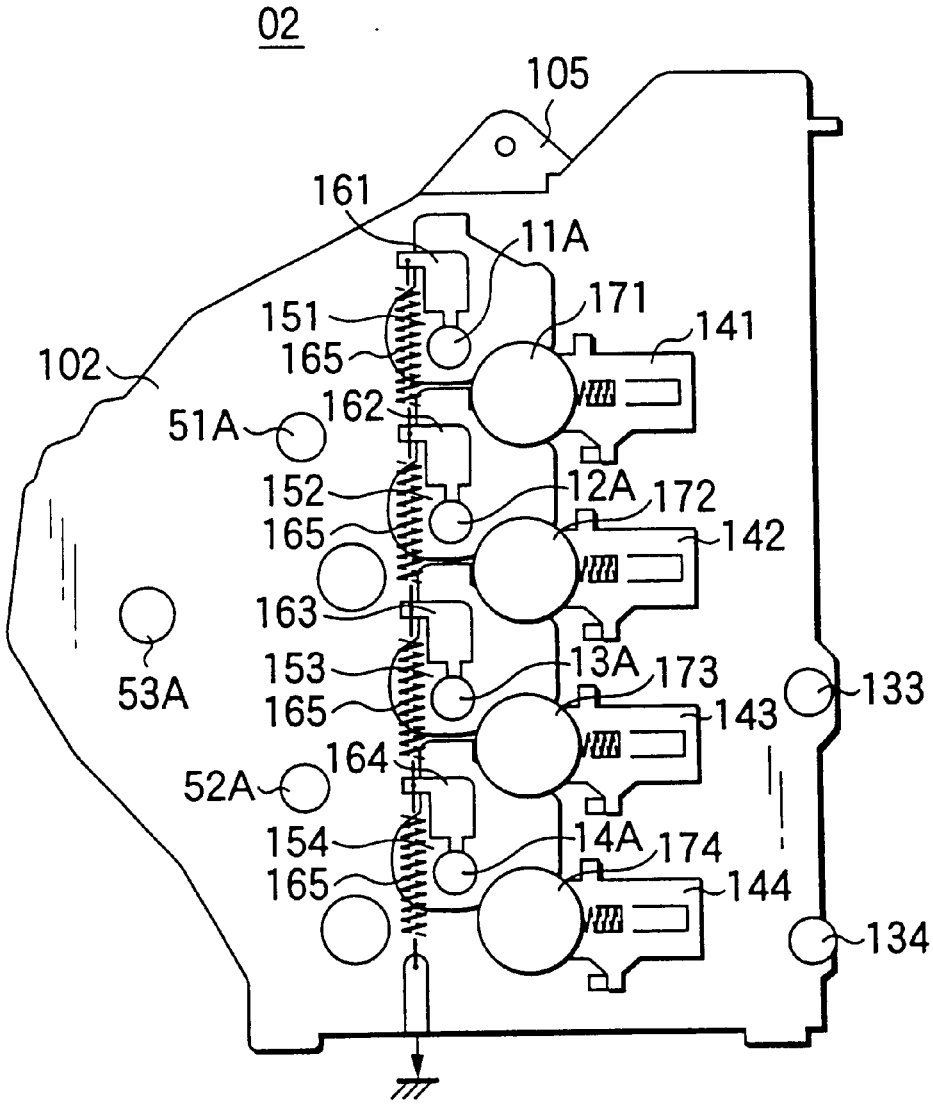
FIG. 11 is a right side view showing the assembly unit.
Figure 12:
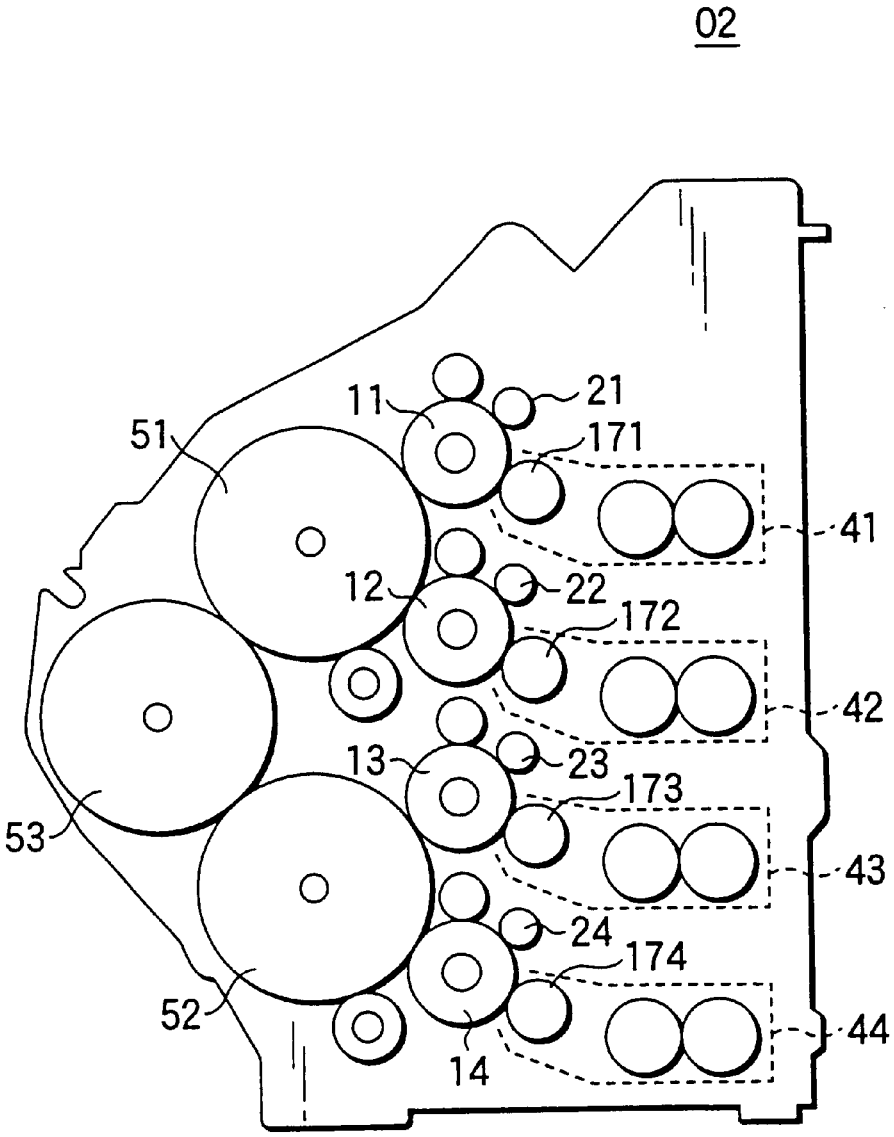
FIG. 12 is a cross sectional view showing the assembly unit, taken along a line E–E' shown in FIG. 9.

FIGS. 9 to 12 show the embodiment of the image forming unit (unit assembly) 02 shown in FIG. 3 more concretely and in more detail. FIG. 9 is a front view of the unit assembly; FIG. 10 is a left side view of the same; FIG. 11 is a right side view of the same; and FIG. 12 is a transverse cross sectional view of the same taken along a line E–E' in FIG. 9. As shown in FIG. 12, the image forming unit 02 has the photoreceptor drums 11, 12, 13, 14 as the image carrying bodies, the developing units 41, 42, 43, 44, the charging rolls or charging units 21, 22, 23, 24, and the secondary intermediate transfer drum 53 including the first and second primary intermediate transfer drums 51 and 52, which are used as the intermediate transfer member.

As shown in FIGS. 9 and 10, the photoreceptor drums 11, 12, 13, 14 are supported by photoreceptor drum shafts 11A, 12A, 13A, 14A as image carrying body supporting members, respectively. Those photoreceptor drum shafts 11A, 12A, 13A, 14A are slightly movably supported by a frame of the image forming unit (unit assembly) 02, with gaps being present between those shafts 11A, 12A, 13A, 14A and the frame body. As shown in FIG. 10, the photoreceptor drum shafts 11A, 12A, 13A, 14A are mounted at one end on mounting members 111, 112, 113, 114, and those mounting members 111, 112, 113, 114 are pressed and fixed by pressing members 121, 122, 123, 124. The pressing members 121, 122, 123, 124 are connected to a conductive member 131 fed with electric power from the main body 01 of the apparatus by way of a conductive elastic member such as a spring 132. The other end of the photoreceptor drum shafts 11A, 12A, 13A, 14A are mounted on fixing members 151, 152, 153, 154, respectively. Developing rolls 171, 172, 173, 174 being in contact with the photoreceptor drums 11, 12, 13, 14 are pressed against the photoreceptor drums 11, 12, 13, 14 by pressing members 141, 142, 143, 144, respectively. Bearing members 161, 162, 163, 164 are made of conductive material, and are electrically connected also to the photoreceptor drum shafts 11A, 12A, 13A, 14A. The bearing members 161, 162, 163, 164 are mutually connected by conductive elastic members, such as coiled springs 165 (ground line), and are earthed.

Figure 13:
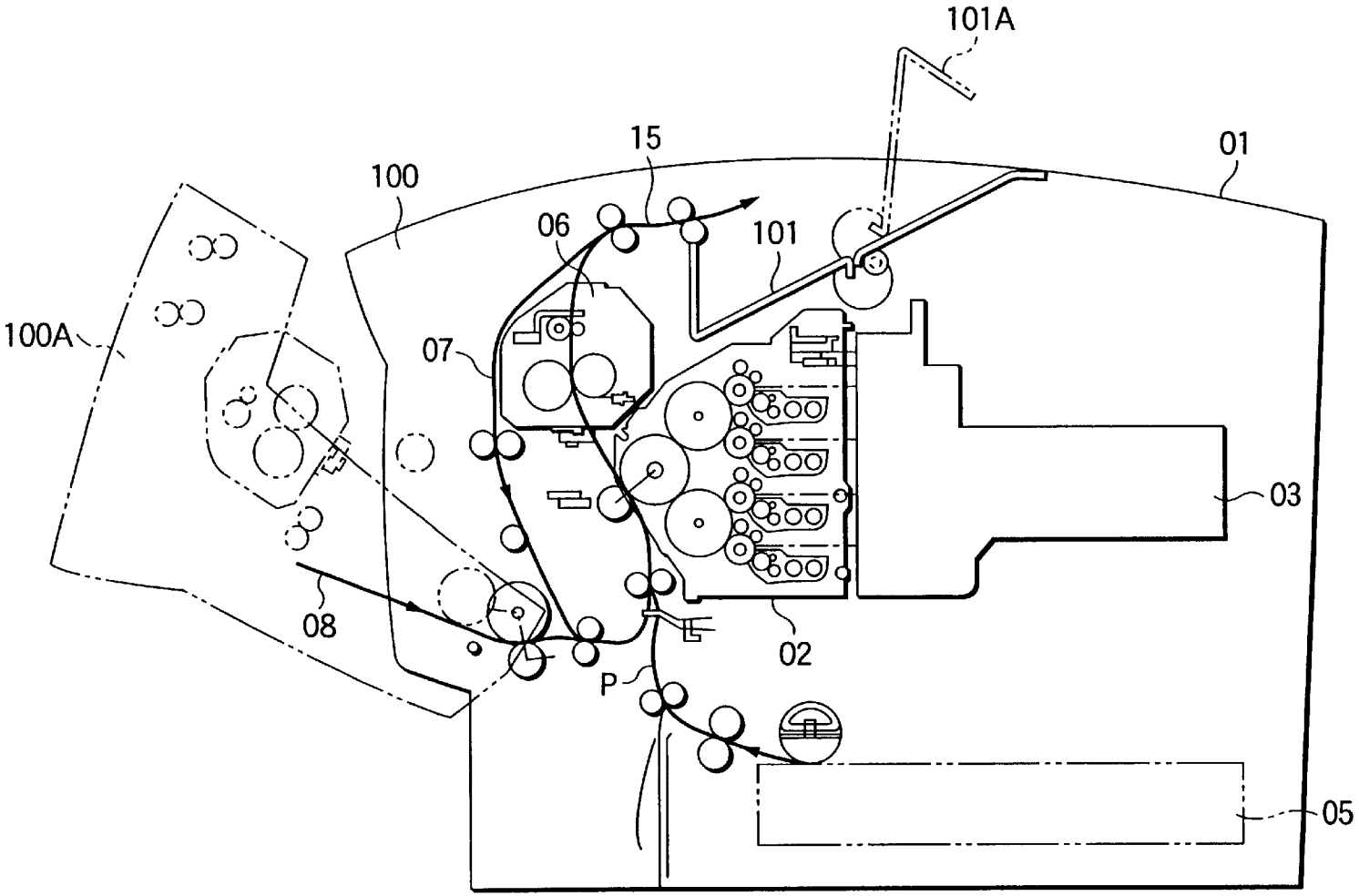
FIG. 13 is a view showing a full color printer which is one form of an image forming apparatus of another embodiment of the present invention.

A mechanical arrangement of another image forming apparatus, which is an embodiment of the present invention, is shown in FIG. 13. FIG. 13 shows a print head device 02 of a tandem type full color printer as the image forming unit 02. As in the FIG. 2 embodiment, the main body 01 of the full color printer of the tandem type contains the image forming unit 02 for forming a full color image. In this embodiment, the image forming unit 02 contains four photoreceptor drums serving as image carrying bodies. The ROS 03 as an exposure unit optically forms images on the four photoreceptor drums. The sheet cassette 05 stores the recording sheets P, and supplies the recording sheets P as recording mediums to the image forming unit 02 so that the recording sheets P travel along the sheet transporting path 15. A fixing unit 06 applies a fixing process to a recording sheet P having a toner image as transferred from the image forming unit 02. A both-side transport path 07 transports a recording sheet P again to a transfer section of the image forming unit 02 in a state that the recording sheet P is inverted. A manual inserting device 08 is used for feeding a desired recording sheet P to the main body 01, from the outside of the main body 01. A sheet discharging tray 101 for discharging the recording sheets P having images formed thereon, is disposed in an upper part of the main body 01 in an integral form.

The sheet transporting path 15, as shown in FIG. 13, is shaped like a C as viewed from the side of the apparatus. As shown in FIG. 13, in the image forming apparatus, the image forming unit 02 as a unit assembly may be pulled out of the main body 01 and inserted thereinto from the top in a manner that a cover 100 of the main body 01 of the image forming apparatus is tilted to a position indicated by reference numeral 100A, the sheet discharging tray as upper cover 101 is turned to a position as denoted as 101A to open the upper part thereof.

In the image forming unit 02 as the unit assembly of the invention, the axes of the photoreceptor drums 11, 12, 13, 14 are contained in a single axes-contained plane "M", and those axes are parallel to each other (See FIG. 3). As shown in FIG. 9, the photoreceptor drum shafts 11A, 12A, 13A, 14A of the photoreceptor drums 11, 12, 13, 14 are protruded out of the sides of the image forming unit 02. The image forming unit 02 may be inserted to and removed from the main body 01 in directions substantially parallel to the axes-contained plane "M" and in the direction which is substantially the same as the transporting direction of the recording sheet P at the time of the final transferring to the transfer member. The photoreceptor drums 11, 12, 13, 14 as the image carrying bodies are supported by an integral frame, and are positioned to the apparatus main body side.

Figure 14:
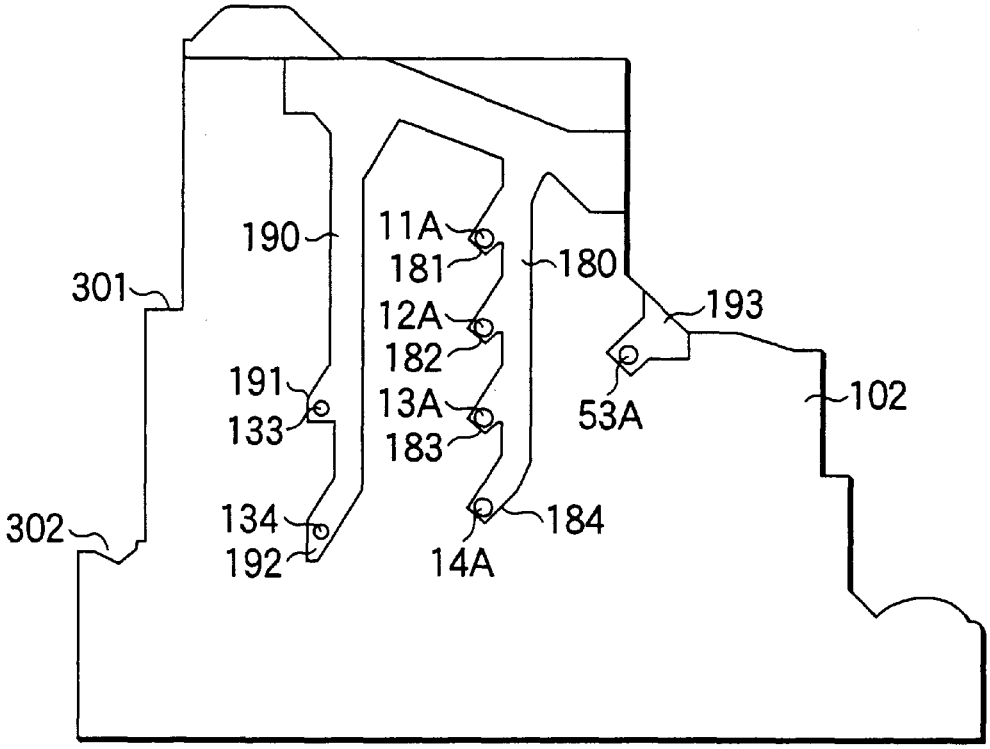
FIG. 14 is a front view showing the inner side of a side wall of the main body.

FIG. 14 is a side view showing a body side wall 102 of the main body forming the housing of the image forming apparatus as viewed from the main body inside. In the figure, a guide groove 180 for guiding the photoreceptor drum shafts 11A, 12A, 13A, 14A, which are protruded from the sides of the image forming unit (unit assembly) 02, is illustrated. The guide groove 180 is vertically formed. The image forming unit (unit assembly) 02 is vertically inserted to and removed from the apparatus main body, while being guided along the guide groove 180. The guide groove 180 branches off into four branch paths 181, 182, 183, 184. A guide groove 190 and branch paths 191 and 192 are provided for auxiliary protrusions 133 and 134 of the unit assembly 02. Further, a guide 193 for fixing a shaft 53A of the secondary intermediate transfer drum 53 is provided. The photoreceptor drum shafts 11A, 12A, 13A, 14A are guided to the inner part of the branch paths 181, 182, 183, 184, and fixed to the V-shaped grooves of the main body. The branch paths 181, 182, 183, 184 are inclined with respect to the guide groove 180 at an angle of about 45°. When the photoreceptor drum shafts 11A, 12A, 13A, 14A of the unit assembly 02 are downwardly moved in the guide groove 180, those shafts advance into the branch paths 181, 182, 183, 184, and are positioned and fixed to the inner ends of those branch paths 181, 182, 183, 184. The developing units 41, 42, 43, 44 are pressed toward and positioned to the surfaces of the photoreceptor drums 11, 12, 13, 14 so that the developing units 41, 42, 43, 44 are spaced from the drum surfaces by fixed distances.

Guide groove 190, while disposed parallel to the guide groove 180, is provided in the body side wall 102 of the main body at a position located apart from the guide groove 180. Auxiliary protrusions (133, 134) provided on the side surface of the unit assembly 02 are inserted into the guide groove 190. The guide groove 190 branches off into branch paths 191 and 192. The branch paths 191 and 192 are provided at height positions which are different from those of the branch paths 181, 182, 183, 184 of the guide groove 180, except the lowermost end thereof. Accordingly, there is no chance that the photoreceptor drum shafts 11A, 12A, 13A, 14A enter other branch paths than those associated therewith. One or a plurality of the protrusions are inserted into the guide groove 190. The function mentioned above may be achieved by the insertion of at least one protrusion. When two protrusions are inserted as shown in FIG. 5, the inserting operation of the unit assembly 02 is stable. The number of protrusions to be inserted may be three or more, as a matter of course. In FIG. 5, the guide groove 193 for positioning and fixing the shaft 53A of the secondary intermediate transfer drum 53 is also illustrated.

When the image forming unit (unit assembly) 02 is removed from the main body of the apparatus, the photoreceptor drum shafts 11A, 12A, 13A, 14A move upwardly along the branch paths 181, 182, 183, 184. Accordingly, the unit assembly 02 is moved in an oblique direction with respect to the axes-contained plane, and then moved in the direction almost parallel to the axes-containing plain.

The intermediate transfer drums 51, 52, 53 are provided as image carrying body drums, in addition to the photoreceptor drums 11, 12, 13, 14. The intermediate transfer drums 51, 52, 53 may be fixed in a manner similar to the fixing manner of the photoreceptor drums 11, 12, 13, 14, or may be fixed onto the side wall of the unit assembly 02.

The ROS 03 is supported on the side body wall 102 of the main body 01, which is used for positioning and fixing the image forming unit (unit assembly) 02. ROS supports 301 and 302 shown in FIG. 14 are provided on the side wall 102 of the main body 01, and support a part of the ROS 03. Supported parts, which may be brought into contact with the ROS unit supports 301 and 302, are provided also on the ROS 03. Accordingly, the ROS 03, the photoreceptor drum shafts 11A, 12A, 13A, 14A protruding from the sides of the image forming unit (unit assembly) 02 and the like are supported by the body side wall 102 of the main body 01. The ROS 03 and the body side wall 102 are made of the same material. This material may be appropriately selected in accordance with the configuration, structure, and specifications of the image forming apparatus. In order to maintain such a position accuracy as to suppress color misregistration for the use time of the image forming apparatus, use of a material having a relatively large hardness is preferable. For example, polycarbonate containing 40% glass fiber may be used for the material of the ROS 03 and the body side wall 102.

As shown in FIG. 13, in the image forming apparatus of the embodiment, the sheet cassette 05 is disposed in a lower part of the apparatus, and the sheet discharging portion (upper cover 101) is disposed in an upper part of the apparatus. A direction in which a transfer member (recording sheet P) is transported at the time of image transferring (=direction of the sheet transporting path 15) is substantially vertical (not less than 45° with respect to the horizontal direction). The axes-contained plane of the photoreceptor drum shafts 11A, 12A, 13A, 14A is substantially vertical with respect to the horizontal direction. With this arrangement, the sheet transporting path 15 may be formed as a C-path structure, so that the C-path structure could be realized in the color tandem machine without degrading the color misregistration accuracy and impairing the operability. This technical feature greatly contributes to the size reduction of the printer.

Figure 15A:
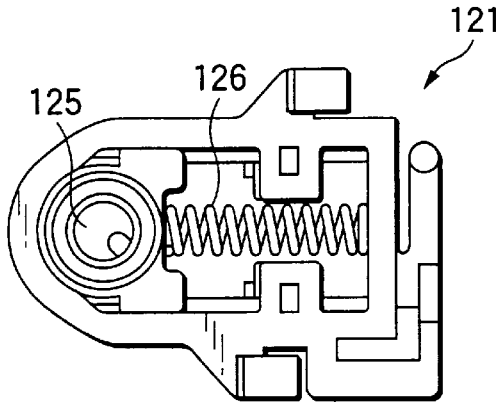
FIG. 15A is a front view showing a pressing member.
Figure 15B:
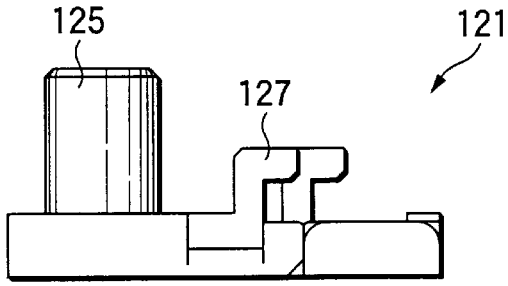
FIG. 15B is a side view of the same.
Figure 15C:
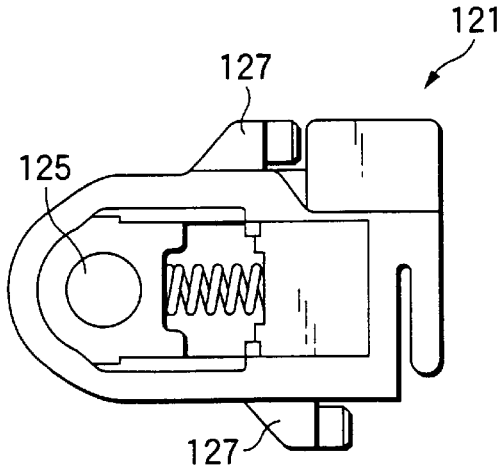
FIG. 15C is a rear elevation of the same.
Figure 16A:
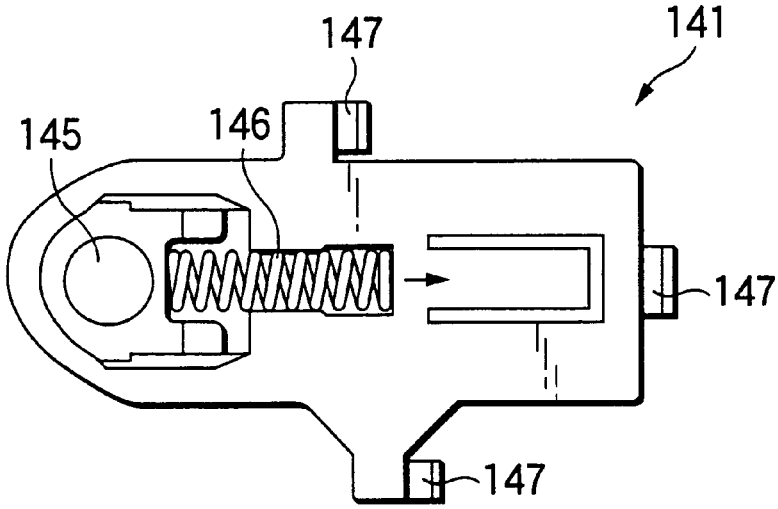
FIG. 16A is a front view showing a pressing member and FIG. 16B is a side view of the same.
Figure 16B:
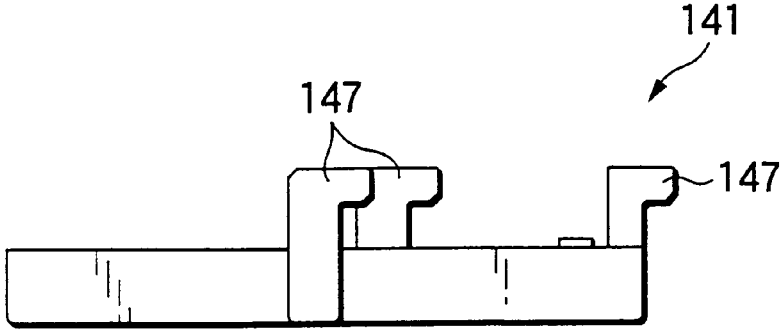

FIGS. 15A–15C are diagrams showing an instance of the pressing member 121 used in the embodiment. FIG. 15A is a front view showing the pressing member 121; FIG. 15B is a side view of the same; and FIG. 15C is a rear elevation of the same. As shown in FIGS. 15A–15C, the pressing member 121 includes a spring 126 for pressing an engaging part 125 to be brought into engagement with the photoreceptor drum shaft 11A, 12A, 13A, 14A, and it is brought into engagement with the side wall 102 of the unit assembly 02 by an engaging pawl 127. The pressing member 121 thus constructed elastically presses and holds the photoreceptor drum shafts 11A, 12A, 13A, 14A. In the embodiment, four photoreceptor drum shafts 11A, 12A, 13A, 14A are designed to have the same structure. The photoreceptor drum shafts 11A, 12A, 13A, 14A include mechanisms operating such that when the image forming unit (unit assembly) 02 is inserted to the main body 01 of the image forming apparatus, the mechanisms position and fix those shafts 11A, 12A, 13A, 14A to the housing of the main body 01 of the image forming apparatus. FIG. 16A is a front view showing a pressing member 141. FIG. 16B is a plan view showing the same. As shown in FIGS. 16A and 16B, the pressing member 141 includes a spring 146 which presses an engaging part 145, which comes in engagement with and fastens the developing roll 171, 172, 173, 174, and presses the developing roll 171, 172, 173, 174 against the photoreceptor drum 11, 12, 13, 14. An engaging pawl 147 engages with the side wall 102 of the unit assembly 02, and presses and elastically holds the developing roll 171, 172, 173, 174.

Figure 19:
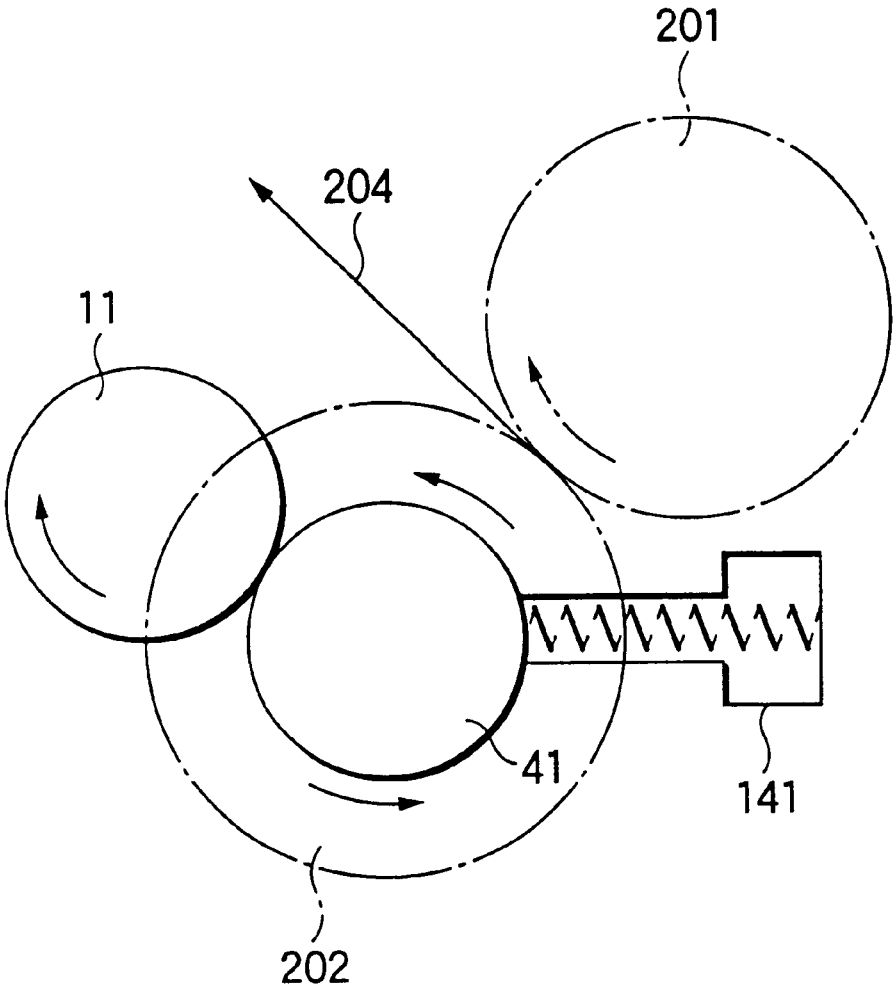
FIG. 19 is a side view showing an arrangement of gears.

The developing units 41, 42, 43, 44 are driven by a developing-unit driving device which is provided in the main body 01. The developing-unit driving device is different from a driving device for the photoreceptor drums 11 to 14. In the developing-unit driving device, gears are arranged such that a tangential load of the gears, which operates when the driving device is driven, does not produce such a component of force as to cancel a pressing force applied from the developing rolls 171, 172, 173, 174 of the developing units 41, 42, 43, 44 to the drum surfaces of the photoreceptor drums 11, 12, 13, 14. FIG. 19 exemplarily illustrates such an arrangement of gears. As shown, gears 201 and 202 are arranged such that a tangential load 204 of the gears 201 and 202 does not produce such a component of force as to reduce a pressing force of the pressing member 141, which generates the pressing force.

Figure 17:
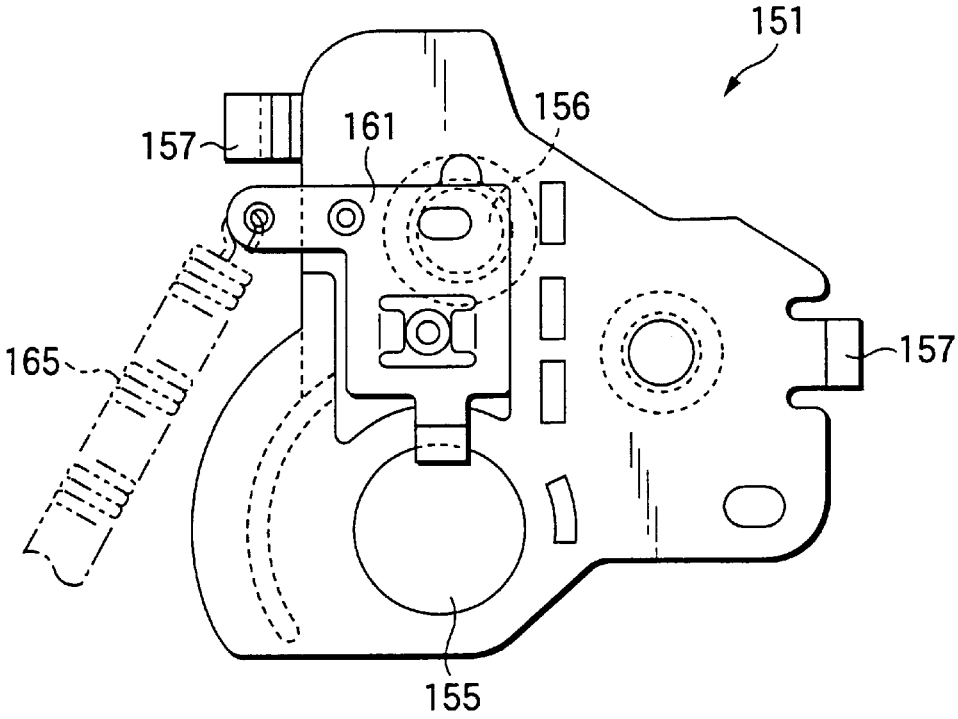
FIG. 17 is a front view showing a turn preventing mechanism.

The charging units 21, 22, 23, 24 are positioned and fixed to the photoreceptor drum shafts 11A, 12A, 13A, 14A of the photoreceptor drums 11, 12, 13, 14, and have turn preventing mechanisms (fixing members) 151, 152, 153, 154, which prevent the charging units 21, 22, 23, 24 from turning in the drum circumferential direction and are minutely movably supported by the frame of the image forming unit (unit assembly) 02 with gaps. The turn preventing mechanisms 151, 152, 153, 154 respectively include the bearing members 161, 162, 163, 164, which support the roll shafts of the charging unit rolls. FIG. 17 is a diagram showing the turn preventing mechanism 151, which includes a fitting hole 155 into which the shaft 11A of the photoreceptor drum 11 is fit, a roll bearing 156 of the roll of the charging unit 21, and engaging pawls 157 which engage with the side wall 102 of the image forming unit (unit assembly) 02. The roll bearing 156 is mounted on the bearing member 161, and is mounted on the turn preventing mechanism 151 with a minute gap located therebetween. The bearing members 161, 162, 163, 164 are made of a conductive material, and are electrically connected also to the photoreceptor drum shafts 11A, 12A, 13A, 14A. The bearing members 161, 162, 163, 164 are interconnected by a conductive coiled spring 165 (ground line), and are earthed.

The charging device in which the developing units 41, 42, 43, 44 is fed with electric power from the outside of the image forming unit (unit assembly) 02 via the frame of the image forming unit 02, includes a coiled spring 65 which couples a charging unit support member to a conductive member for feeding electric power to the charging units 21, 22, 23, 24 located on the frame of the image forming unit 02.

Figure 18:
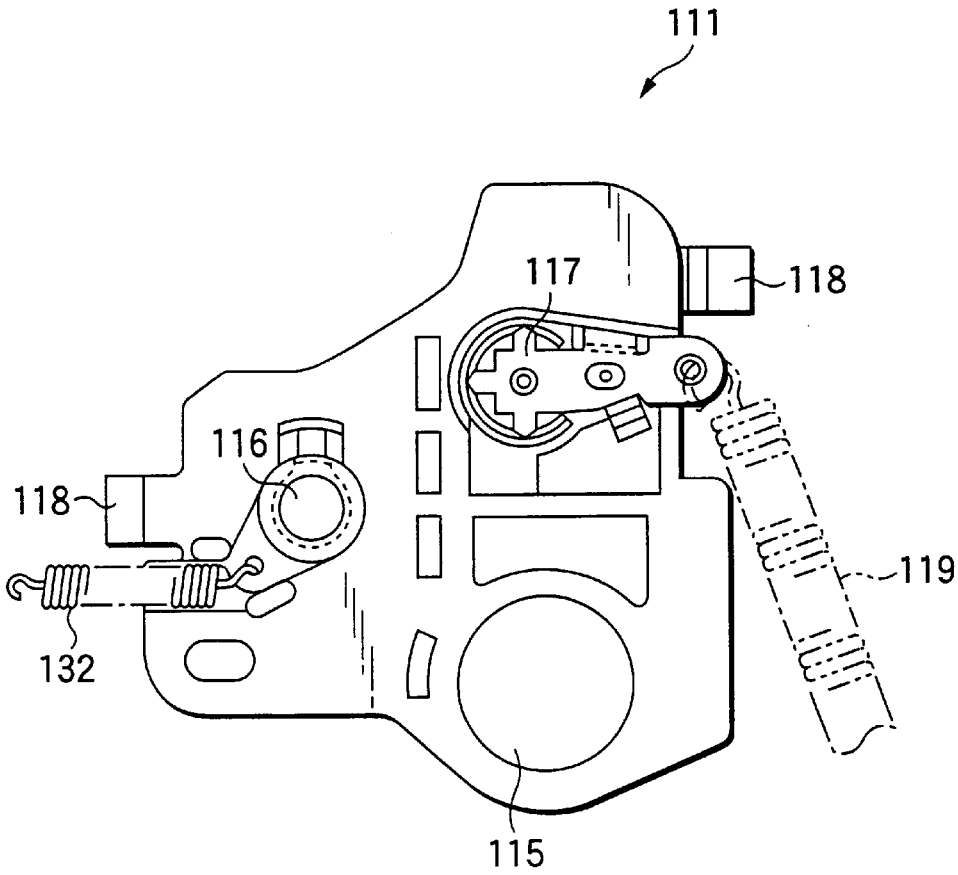
FIG. 18 is a front view typically showing a mounting member.

FIG. 18 is a diagram typically showing one of the mounting members 111, 112, 113, 114 shown in FIG. 10. The mounting member 111 includes a fitting hole 115 into which the photoreceptor drum shaft 11A is fit, a bearing 116 for the charging unit 21, and a power supplying device 117, and further includes engaging pawls 118 which engage the side wall 102 of the unit assembly 02. A coiled spring 119 for feeding electric power is coupled to the mounting member 111. A ground line (coiled spring) 132 is attached to the bearing 116.

In the embodiment, intermediate transfer members (image carrying bodies) are the cylindrical intermediate transfer drums 51, 52, 53, as shown in FIG. 3. The intermediate transfer drum 51, 52, 53 have primary transfer drums 51 and 52 onto which images are transferred from the photoreceptor drums 11, 12, 13, 14, and a secondary transfer drum 53 onto which the images are transferred from the primary transfer drums 51, 52. The secondary transfer drum 53, cylindrical in shape, functions to transfer the image thereon to a recording sheet P. The intermediate transfer drums 51, 52, 53 are respectively supported by intermediate transfer drum shafts 51A, 52A, 53A. At least one of the intermediate transfer drum shafts 51A, 52A, 53A is minutely movably supported by the frame of the image forming unit 02 with a gap and has a mechanism for positioning and fixing the shafts 51A, 52A, 53A of the intermediate transfer drums 51, 52, 53 to the housing of the image forming apparatus main body 01 when the intermediate transfer drums 51, 52, 53 are installed to the image forming apparatus main body 01.

The embodiment is the unit assembly 02 which has the four photoreceptor drums 11, 12, 13, 14, the two primary intermediate transfer drums 51 and 52, and the single secondary intermediate transfer drum 53. The secondary intermediate transfer drum shaft 53A (see FIG. 9) is press-fitted to the frame 102 of the unit assembly 02 to be positioned.

Figure 20:
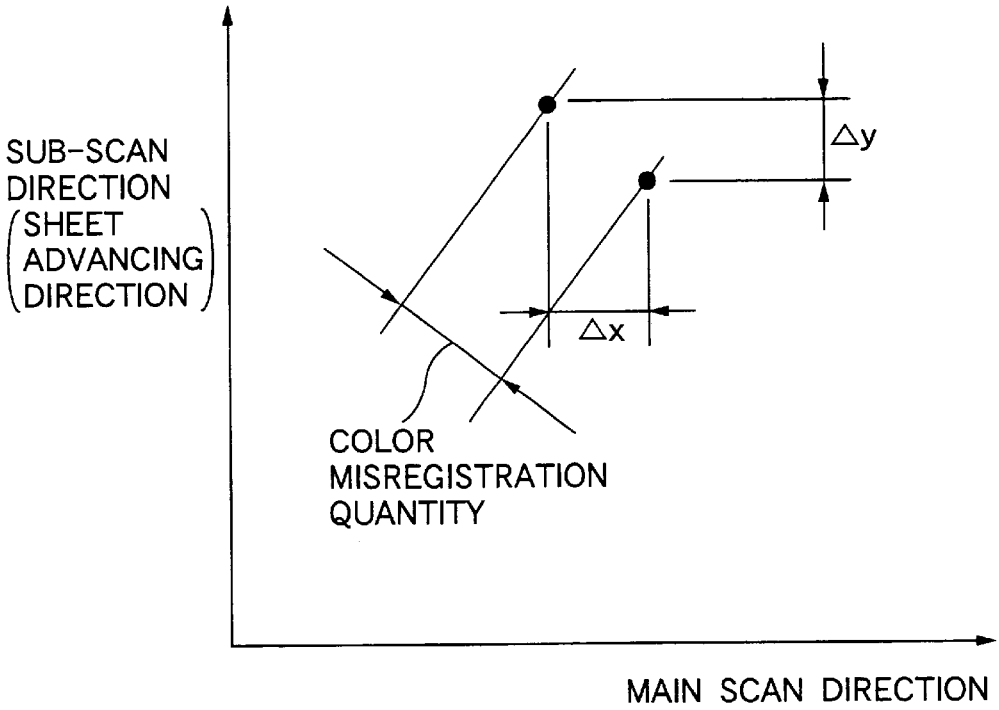
FIG. 20 is a graph for explaining a color misregistration quantity.
Figure 21:
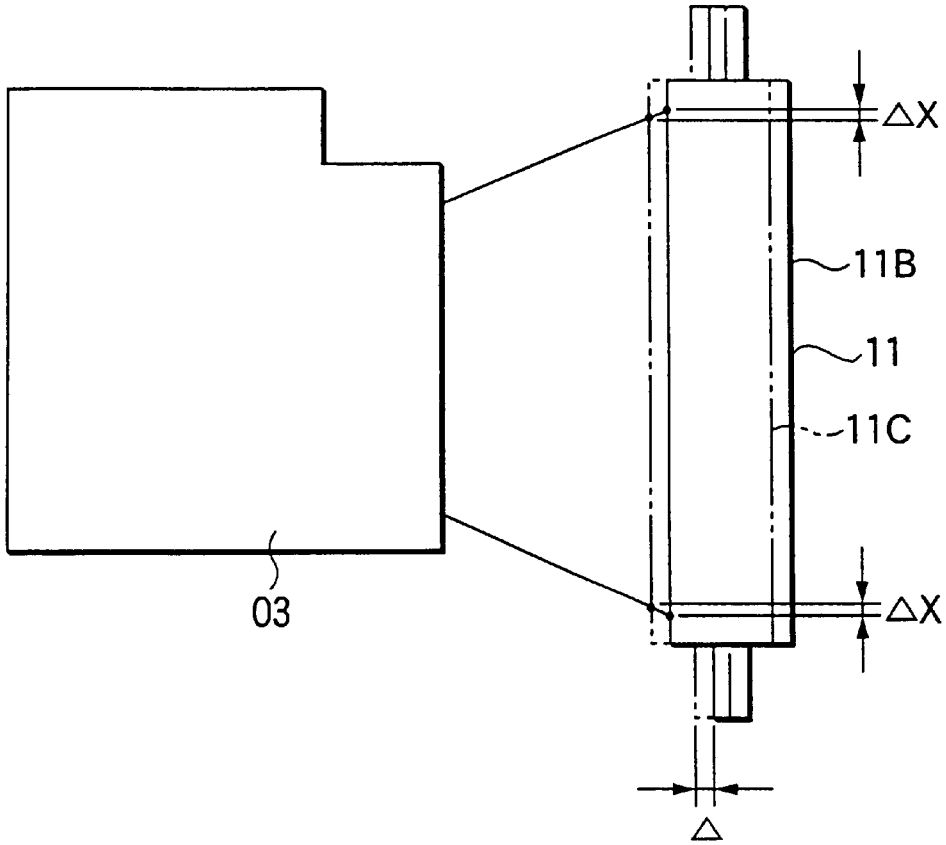
FIG. 21 is an explanatory diagram for explaining a main-scan-direction DC-component color misregistration.
Figure 22:
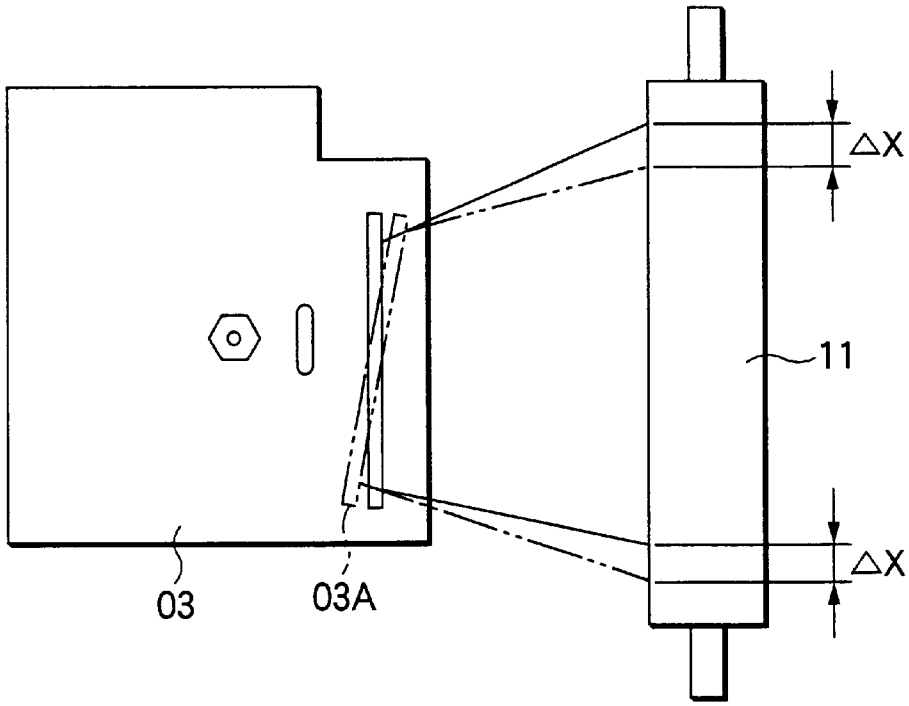
FIG. 22 is another explanatory diagram for explaining the main-scan-direction DC-component color misregistration.
Figure 23:
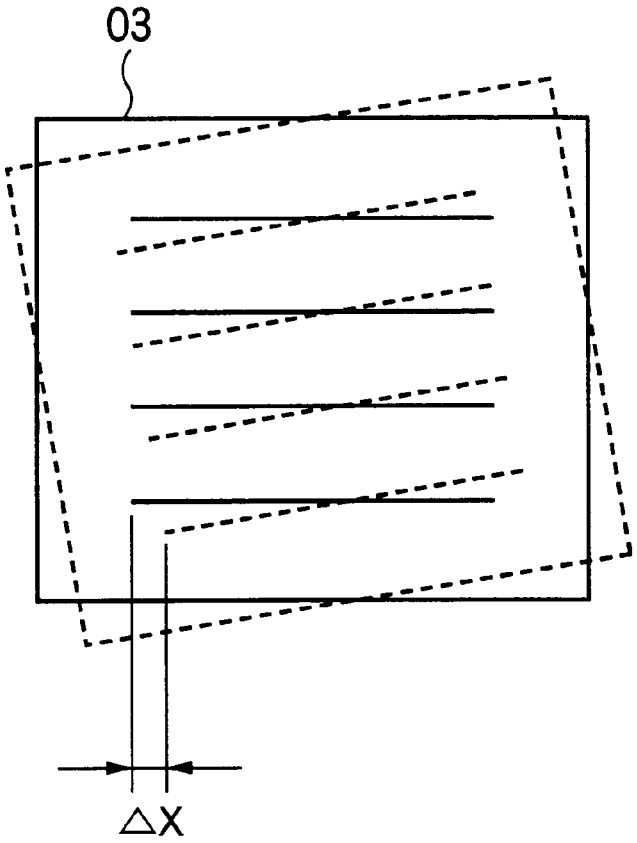
FIG. 23 is yet another explanatory diagram for explaining the main-scan-direction DC-component color misregistration.

The color misregistration will be described. As illustrated in FIG. 20, a quantity of color misregistration is given by $$\text{Color misregistration quantity} = \sqrt{(\Delta x^2 + \Delta y^2)}$$

where Δx is a quantity of color misregistration in the main scan direction (=X-axis direction), and Δy is a quantity of color misregistration in the sub-scan direction (sheet advancing direction=Y-axis direction) (see FIG. 20). Thus, the quantity of color misregistration is defined by a root-mean-square of a quantity of color misregistration in the main scan direction and a quantity of color misregistration in the sub-scan direction. It is said that the color misregistration of about 90 μm or larger can be perceived by the naked eye. Causes of the color misregistration of the DC component in the main scan direction are a position accuracy of the photoreceptor drums 11, 12, 13, 14 (right and left difference), a mounting accuracy of the ROS 03, an accuracy of laser beam scanning start position, and the like. A magnification power difference (right and left difference) is adjusted by varying writing timing of the laser. FIG. 21 is an explanatory diagram for explaining a mechanism of generating the main-scan direction DC component color misregistration and a method of its adjustment, and is a plan view showing a positional relationship between the ROS 03 and the photoreceptor drum 11. In a case where a difference Δ is present between a position of the photoreceptor drum 11B indicated by a solid line and a position of the photoreceptor drum 11C indicated by a chain line, an image on the photoreceptor drum 11 is displaced by Δx in the main scan direction. For such a displacement, a quantity of color misregistration is adjusted to be within a tolerable level, e.g., 50 μm, by varying a light emitting rate (clock frequency) of the laser. FIG. 21 shows a mechanism of causing the main scan direction DC component color misregistration by an inclination of the mirror in the ROS 03. FIGS. 22 and 23 show a mechanism of causing the main scan direction DC component color misregistration by an inclination of the mirror which is due to a mounting accuracy of the ROS 03. Those causes may be reduced to be within a tolerable level, e.g., 50 μm, by adjusting writing timing of the laser.

Figure 24:
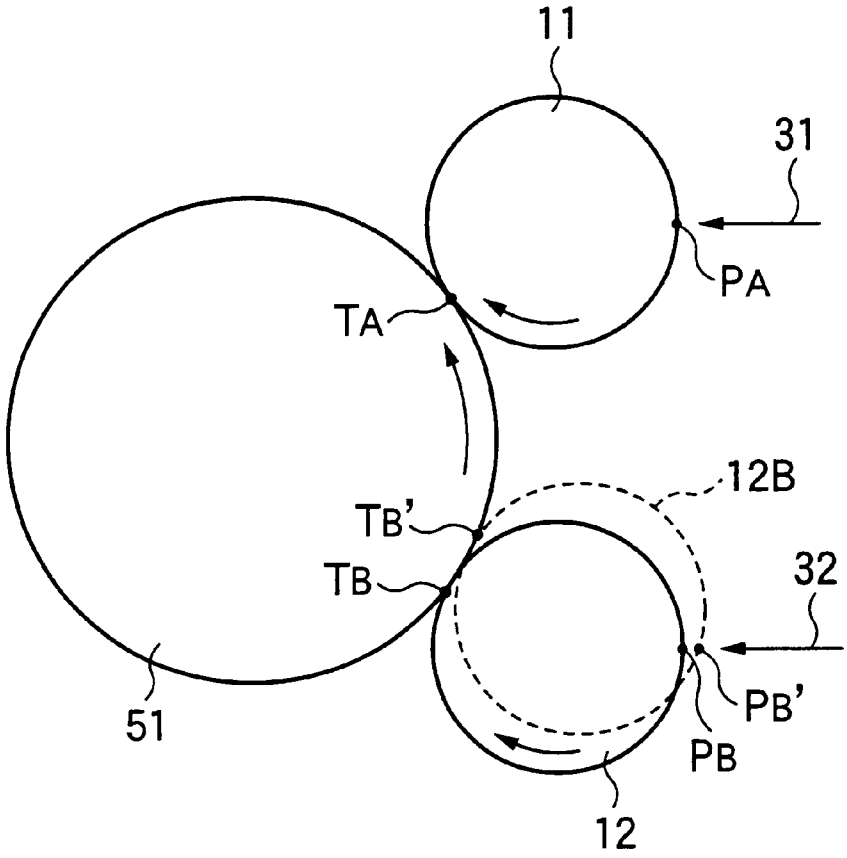
FIG. 24 is an explanatory diagram for explaining a sub-scan-direction DC-component color misregistration.

Causal factors of the color misregistration of the DC component in the sub-scan direction, as shown in FIG. 24, are a position accuracy of the laser beams 31 and 32 (right and left difference, the whole), a position accuracy of the photoreceptor drums 11 and 12 (right and left difference, the whole), and a position accuracy of the intermediate transfer drum 51 (right and left difference, the whole). FIG. 24 is an explanatory diagram for explaining a sub-scan-direction DC-component color misregistration. When the photoreceptor drum 12 is displaced to a position as denoted as 12B. In an image on the photoreceptor drum 11 and an image on the photoreceptor drum 12, a color misregistration is created which is defined by a difference between a development length L1 of $P_B-T_B-T_A$ and a development length L2 of $P_{B'}-T_{B'}-T_{A'}$. The development lengths vary even when the landing positions of the laser beams 31 and 32 are displaced and the first primary intermediate transfer drum 51 is displaced. The same thing is true for the position of the photoreceptor drum 11 and the landing position of the laser beam 31. Those color misregistration quantities are accumulated into a color misregistration quantity of the DC component in the sub-scan direction on the final image on the recording sheet P. A color misregistration quantity on the recording sheet P is measured; it is converted into time by using a rotational speed of the photoreceptor drum; a writing timing of the laser light is adjusted by using the time as converted; and the color misregistration is reduced into a tolerable level, e.g., 70 μm or smaller.

As described above, the color misregistration has such causal factors as the position accuracy of the photoreceptor drum shaft 11A, 12A, 13A, 14A and the position accuracy of the laser beams 31, 32, 33, 34 of the ROS 03, and a high accuracy of several tens μm is required for satisfying the tolerable level. Actually, it is difficult to satisfy such a high accuracy as required, and the measure currently taken for preventing the color misregistration is to adjust the timing of each laser beam 31, 32, 33, 34. Accordingly, it is necessary to exactly position and fix the photoreceptor drum shafts 11A, 12A, 13A, 14A to the apparatus main bodies so as to eliminate the work of those adjustments when the user replaces the image forming unit including the photoreceptor drums 11, 12, 13, 14.

Before delivery from the factory, the color misregistration of the image forming apparatus to be delivered is adjusted by using the writing timings of the ROS 03 in both the main scan and sub-scan directions and reading timing clock frequency of the ROS 03, on the basis of the final image print. The color misregistration is greatly affected by the position accuracy of the drums 11, 12, 13, 14. In the invention, their adjustment is carried out by controlling the electrical time, not by adjusting those positions. For this reason, it is necessary to position the photoreceptor drum shafts 11A, 12A, 13A, 14A to the main body 01.

As seen from the foregoing description, an image forming apparatus has an image forming unit, in which the image forming unit includes a plurality of image carrying bodies, the image forming unit is a unit assembly, and the unit assembly is formed to be detachable from a main body of the image forming apparatus. Further, if necessary, the unit assembly selectively includes a plurality of developing units, a plurality of charging units, and at least one intermediate transfer drum. Accordingly, the unit assembly may be replaced like a single component. Therefore, a mental strain of the user when he or she replaces the unit assembly with another unit assembly is remarkably reduced.

The image carrying bodies are supported by the image carrying body rotating shafts, and at least one of the rotating shafts is minutely movably supported by the frame of the unit assembly with a gap being located therebetween, and such a mechanism that when the unit assembly is inserted to the image forming apparatus body, the rotating shaft is positioned and fixed to the housing of the image forming apparatus body. Therefore, the invention succeeds in preventing the color misregistration accuracy from being deteriorated, and succeeds in reducing the mental strain of the user when he replaces the unit assembly with another unit assembly.

The developing units are pressed against the surfaces of the image carrying bodies to be positioned while maintaining a predetermined gap between the developing units and the surfaces of the image carrying bodies. Accordingly, the developing units are accurately positioned to the image carrying bodies to have the predetermined gap therebetween, and hence, the developing performance is prevented from being degraded.

The image forming units receive a drive force from a developing-unit driving device, which is different from the image carrying body driving device. The gears are arranged such that a reaction force of the gear which operates when the driving device is driven to operate does not produce such a component of force as to cancel a pressing force applied to a surface of the image carrying body of each developing unit. Accordingly, when the drive force is input from the main body to the developing units, there is no chance that the developing unit positioning accuracy is deteriorated by the gear reaction.

The charging units are positioned and fixed to a shaft of the image carrying bodies, and a turn preventing mechanism is provided which is minutely movably supported on a frame of the unit assembly with a gap being located therebetween, and functions to prevent the charging units from turning in the circumferential direction of the image carrying body. Therefore, the exact positional relations of the charging units to the image carrying bodies are kept, thereby preventing the degradation of the charging performance of the charging units.

Ground lines through the coiled springs, which are connected to the drum shafts of the earthed image carrying bodies, are provided. Therefore, there is no degradation of the electric power feeding (earthing) performance even if the rotary shafts of the image carrying bodies are slightly moved when the rotary shafts are positioned and fixed to the housing of the main body of the image forming apparatus. The conductive member for feeding electric power to the charging unit located on the frame of the unit assembly is coupled, by the coiled springs, to the charging-unit holding member. Therefore, the electric power feeding performance is kept in a satisfactory level at all times.

The intermediate transfer members are cylindrical intermediate transfer drums. The intermediate transfer drum includes a primary transfer drum onto which an image is transferred from the image carrying body associated drum, and a secondary transfer drum onto which an image is transferred from the primary transfer drum, and the secondary transfer drum is a drum for transferring an image from the drum onto a sheet of paper. The intermediate transfer member is supported by the intermediate transfer member shaft, at least one of the intermediate transfer member shafts is minutely movably supported by the frame of the unit assembly with a gap being present therebetween, and wherein a mechanism in which when it is installed to the main body of the image forming apparatus, the rotary shafts are positioned and fixed to the main body of the image forming apparatus. Therefore, in the unit assembly including the rotary shafts of the intermediate transfer units, which greatly affects the color misregistration, the invention succeeds in preventing the color misregistration accuracy from being deteriorated, and succeeds in eliminating the color misregistration adjustment work when replacing the unit assembly with another unit assembly.

Four image carrying body drums, two primary intermediate transfer drums, and one secondary intermediate transfer drum. Each second intermediate transfer drum shaft is press fit into the frame of the unit assembly. Therefore, the maintenance is easy.

The invention succeeds in realizing a mechanism for the C-path transport system, which is advantageously applied to a small printer, in a color tandem machine, without lowering the color misregistration accuracy and deteriorating the operability. In the present invention, there is provided an image forming apparatus, an image forming unit including a plurality of image carrying bodies is constructed as a unit assembly. The unit assembly is an assembly having a plurality of image carrying bodies of which the axial lines are placed in an axes-contained plane. The unit assembly is inserted into and removed from the apparatus main body in a direction which is substantially parallel to the axes-contained plane and substantially the same as the transfer member transporting direction at the time of the final transfer to the transfer member. Accordingly, the unit assembly may be inserted into and removed from the main body in such a direction as not to deteriorate the operability.

The image carrying bodies are supported by one frame, so that the operability is further improved. The image carrying bodies are positioned to the main body of the image forming apparatus.

Guides for guiding the support shafts of the image carrying bodies which are positioned on the apparatus main body side when the unit assembly is installed, are provided on the main body side. Accordingly, the unit assembly is inserted into and removed from the main body while being guided by the image carrying body support shafts. This feature brings about the cost and size reduction of the image forming apparatus.

When the unit assembly is removed from the main body, the unit assembly, while being guided by the guides, is moved in an oblique direction with respect to the axes-contained plane, and then moved in the direction almost parallel to the axes-containing plain. The widthwise space is saved by commonizing the configuration of the apparatus main body. One or a plurality of protrusions, which are different from the image carrying bodies support shafts, are provided on a frame of the unit assembly, and the protrusions are guided by other guide grooves which are provided on a housing of the image forming apparatus main body. This feature effectively prevents an erroneous operation.

In the image forming apparatus of the invention, a sheet feeding portion is located at a lower position and a sheet discharging portion is located at an upper position, a direction in which a transfer member is transported at the time of image transferring is substantially vertical (45° or larger with respective to a horizontal direction). Accordingly, the image carrying bodies are arrayed substantially vertically. The sheet transport path may be formed as a C-path structure. This feature contributes to the apparatus size reduction.

What is claimed is:

1. An image forming apparatus comprising an image forming unit, wherein the image forming unit includes a plurality of image carrying bodies;

wherein the image forming unit is a unit assembly; and wherein the unit assembly is formed to be detachable from a main body of the image forming apparatus and the unit assembly is disposed in the main body of the image forming apparatus by downwardly moving the unit assembly.

2. The image forming apparatus according to claim 1, wherein the plurality of image carrying bodies are a plurality of latent image carrying bodies.

3. The image forming apparatus according to claim 1, wherein the plurality of image carrying bodies are a plurality of intermediate transfer members.

4. The image forming apparatus according to claim 3, wherein the plurality of intermediate transfer members are cylindrical intermediate transfer drums.

5. The image forming apparatus according to claim 3, wherein the plurality of intermediate transfer drums include a primary transfer drum onto which an image is transferred from the plurality of image carrying bodies and a secondary transfer drum onto which the image is transferred from the primary transfer drum; and wherein the secondary transfer drum is a drum for transferring the image thereon onto a sheet of paper.

6. The image forming apparatus according to claim 1, wherein the plurality of image carrying bodies are a plurality of latent image carrying bodies and one intermediate transfer member.

7. The image forming apparatus according to claim 1, wherein the plurality of image carrying bodies are one latent image carrying body and one intermediate transfer member.

8. The image forming apparatus according to claim 1, wherein the plurality of image carrying bodies are a plurality of latent image carrying bodies and a plurality of intermediate transfer members.

9. The image forming apparatus according to claim 1, wherein the unit assembly includes a handle on an upper surface thereof.

10. The image forming apparatus according to claim 1, wherein the unit assembly is disposed in the main body of the image forming apparatus by a single action of downwardly moving the unit assembly.

11. An image forming apparatus comprising an image forming unit, wherein the image forming unit includes a plurality of image carrying bodies;

wherein the image forming unit is a unit assembly;

wherein the unit assembly is formed to be detachable from a main body of the image forming apparatus; and wherein a positioning member for positioning the unit assembly when the unit assembly is disposed in the main body of the image forming apparatus is integrally molded.

12. The image forming apparatus according to claim 11, further comprising an exposure unit for forming a latent image on the image carrying bodies, wherein the exposure unit is supported by the positioning member integrally molded.

13. The image forming apparatus according to claim 12, wherein the positioning member and a housing of the exposure unit are made of the same material.

14. The image forming apparatus according to claim 11, wherein the plurality of image carrying bodies are supported by a plurality of image carrying body supporting members;

wherein at least one of the plurality of image carrying body supporting members is minutely movably supported by a frame of the unit assembly with a gap; and wherein when the unit assembly is disposed in the main body of the image forming apparatus, the positioning member positions and fixes at least one of the supporting members.

15. An image forming apparatus comprising an image forming unit, wherein the image forming unit includes a plurality of image carrying bodies;

wherein the image forming unit is a unit assembly;

wherein the unit assembly is formed to be detachable from a main body of the image forming apparatus;

wherein the plurality of image carrying bodies are supported by a plurality of image carrying body supporting members;

wherein at least one of the plurality of image carrying body supporting members is minutely movably supported by a frame of the unit assembly with a gap; and wherein when the unit assembly is disposed in the main body of the image forming apparatus, at least one of the plurality of image carrying body supporting members is positioned and fixed to a housing of the main body of the image forming apparatus.

16. An image forming apparatus comprising an image forming unit, wherein the image forming unit includes a plurality of image carrying bodies;

wherein the image forming unit is a unit assembly;

wherein the unit assembly is formed to be detachable from a main body of the image forming apparatus;

wherein the unit assembly includes a plurality of developing units; and wherein the developing units are pressed against surfaces of the plurality of image carrying bodies to be positioned so that predetermined gaps are present between the developing units and the surfaces of the plurality of image carrying bodies.

17. An image forming apparatus comprising an image forming unit, wherein the image forming unit includes a plurality of image carrying bodies;

wherein the image forming unit is a unit assembly;

wherein the unit assembly is formed to be detachable from a main body of the image forming apparatus;

wherein the unit assembly includes a plurality of developing units;

wherein the developing units receive drive forces from a developing-unit driving device located in the main body of the image forming apparatus;

wherein the developing-unit driving device is different from an image carrying body driving device; and wherein in the developing units, gears are arranged such that a tangential load of the gear, which operates when the developing-unit driving device is driven, does not produce such a component of force as to cancel a pressing force applied to a drum surface of each of the developing units.

18. An image forming apparatus comprising an image forming unit, wherein the image forming unit includes a plurality of image carrying bodies;

wherein the image forming unit is a unit assembly;

wherein the unit assembly is formed to be detachable from a main body of the image forming apparatus;

wherein the unit assembly includes a plurality of charging units positioned and fixed to shafts of the plurality of image carrying bodies;

wherein the charging units have mechanisms which are minutely movably supported on a frame of the unit assembly with a gap; and wherein the mechanisms prevent the charging units from turning in a circumferential direction of the plurality of image carrying bodies.

19. An image forming apparatus comprising an image forming unit, wherein the image forming unit includes a plurality of image carrying bodies;

wherein the image forming unit is a unit assembly;

wherein the unit assembly is formed to be detachable from a main body of the image forming apparatus; and wherein the plurality of image carrying bodies are earthed and include ground lines, which interconnect shafts of the plurality of image carrying bodies by way of electrically conductive elastic members.

20. An image forming apparatus comprising an image forming unit, wherein the image forming unit includes a plurality of image carrying bodies;

wherein the image forming unit is a unit assembly;

wherein the unit assembly is formed to be detachable from a main body of the image forming apparatus;

wherein the image forming apparatus further comprises a charging device which feeds electric power to a charging unit from outside of the unit assembly by way of a frame of the unit assembly, wherein the charging device includes an electrically conductive elastic member which couples a conductive member for feeding electric power to the charging unit located on a frame of the unit assembly and a charging-unit supporting member.

21. An image forming apparatus comprising an image forming unit, wherein the image forming unit includes a plurality of image carrying bodies;

wherein the image forming unit is a unit assembly;

wherein the unit assembly is formed to be detachable from a main body of the image forming apparatus;

wherein the plurality of image carrying bodies are a plurality of cylindrical intermediate transfer drums;

supported by shafts wherein at least one of the shafts is minutely movably supported by a frame of the unit assembly with a gap; and wherein the at least one of the shafts has mechanisms for positioning and fixing the shafts of the intermediate transfer drums to a housing of the main body of the image forming apparatus when the unit assembly is installed in the main body of the image forming apparatus.

22. The image forming apparatus according to claim 21, wherein the shafts of the intermediate transfer drums are press-fitted into the frame of the unit assembly to be positioned.

23. An image forming apparatus comprising an image forming unit, wherein the image forming unit includes a plurality of image carrying bodies;

wherein the image forming unit is a unit assembly;

wherein the unit assembly is an assembly in which axial lines of the plurality of image carrying bodies are arranged parallel to one another in a plane containing the axes; and wherein the unit assembly is detachable from a main body of the image forming apparatus in a direction of a line perpendicular to the axes in the axes-contained plane.

24. The image forming apparatus according to claim 23, wherein the plurality of image carrying bodies are supported by a single frame.

25. The image forming apparatus according to claim 24, wherein each of the image carrying bodies is positioned to the main body of the image forming apparatus.

26. The image forming apparatus according to claim 25, wherein the main body has guides for guiding ends of image carrying body support shafts to position the unit assembly to the main body of the image forming apparatus.

27. The image forming apparatus according to claim 26, wherein the guides include oblique branch paths for guiding the image carrying body support shafts to fixing positions.

28. The image forming apparatus according to claim 26, wherein at least one protrusion, which is different from the image carrying body support shafts, are provided on a frame of the unit assembly; and wherein guides for guiding the at least one protrusion are provided on a housing of the main body of the image forming apparatus.

29. The image forming apparatus according to claim 23, wherein the image carrying bodies are photoreceptor drums.

30. The image forming apparatus according to claim 23, wherein the plurality of image carrying bodies are photoreceptor drums and intermediate transfer drums.

31. The image forming apparatus according to claim 23, wherein a sheet feeding portion is located at a lower position;

wherein a sheet discharging portion is located at an upper position;

wherein a direction in which a transfer member is transported at the time of image transferring is in a range of from 45° to 90° with respective to a horizontal direction; and wherein the axes-contained plane is a substantially vertical plane with respect to the horizontal direction.

* * * * *